US012662911B2

(12) United States Patent
Theuveny et al.

(10) Patent No.: US 12,662,911 B2
(45) Date of Patent: Jun. 23, 2026

(54) REDUCING $CO_2$ EMISSIONS DURING A WELLBORE CLEAN-UP

(71) Applicant: Schlumberger Technology Corporation, Sugar Land, TX (US)

(72) Inventors: Bertrand Claude Theuveny, Paris (FR); William J. Bailey, Cambridge, MA (US); Kashif Rashid, Cambridge, MA (US); Glen Andrew Hay, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 292 days.

(21) Appl. No.: 18/442,461

(22) Filed: Feb. 15, 2024

(65) Prior Publication Data

US 2025/0264005 A1 Aug. 21, 2025

(51) Int. Cl.

| | |
|---|---|
| ***E21B 37/00*** | (2006.01) |
| ***E21B 41/00*** | (2006.01) |
| ***E21B 47/00*** | (2012.01) |

(52) U.S. Cl.

CPC ..... *E21B 41/0071* (2013.01); *E21B 37/00* (2013.01); *E21B 47/00* (2013.01); *E21B 2200/20* (2020.05)

(58) Field of Classification Search

CPC ..... E21B 41/0071; E21B 37/00; E21B 47/00; E21B 2200/20

USPC ..... 431/5

See application file for complete search history.

(56) References Cited

U.S. PATENT DOCUMENTS

| | | | | |
|---|---|---|---|---|
| 6,629,222 | B1 | 9/2003 | Jeddeloh | |
| 6,775,578 | B2 | 8/2004 | Couet | |
| 8,919,445 | B2 | 12/2014 | Fowler | |
| 10,352,162 | B2 | 7/2019 | Kristensen | |
| 11,668,162 | B2 | 6/2023 | Lopes Pereira | |
| 11,680,464 | B2 | 6/2023 | Bailey | |
| 11,859,815 | B2 | 1/2024 | Al-Shaiji | |
| 2002/0029883 | A1 | 3/2002 | Vinegar | |
| 2008/0133194 | A1* | 6/2008 | Klumpen | G01V 20/00 703/10 |

(Continued)

FOREIGN PATENT DOCUMENTS

| | | | |
|---|---|---|---|
| EP | 4105170 | A1 | 12/2022 |
| WO | 2009015346 | A1 | 1/2009 |

(Continued)

OTHER PUBLICATIONS

Combined Search and Exam Report issued in Great Britain Patent Application No. GB2412383.8 dated Feb. 25, 2025, 6 pages.

(Continued)

*Primary Examiner* — Avinash A Savani

(74) *Attorney, Agent, or Firm* — Jeffrey D. Frantz

(57) ABSTRACT

Systems and methods of the present disclosure includes a mixer configured to mix air and hydrocarbons and a burner configured to receive the mixed air and hydrocarbons and to generate syngas. The system also includes a cooling system configured to receive the syngas and to cool the syngas to form cooled syngas. The system further includes a collector configured to collect carbon from the cooled syngas as soot. Moreover, the system includes a flare stack configured to receive the cooled syngas and to burn off at least part of the cooled syngas.

11 Claims, 12 Drawing Sheets

(56) References Cited

U.S. PATENT DOCUMENTS

| | | | | |
|---|---|---|---|---|
| 2008/0217019 | A1 | 9/2008 | Walker | |
| 2010/0274546 | A1 | 10/2010 | Zafari | |
| 2012/0160011 | A1 | 6/2012 | Whittaker | |
| 2013/0240210 | A1 | 9/2013 | Yale | |
| 2017/0220050 | A1 | 8/2017 | Popa | |
| 2017/0321548 | A1 | 11/2017 | Enkababian | |
| 2017/0327373 | A1 | 11/2017 | de Graffenried, Sr. | |
| 2018/0004234 | A1 | 1/2018 | Dursun | |
| 2019/0120002 | A1 | 4/2019 | Zhang | |
| 2019/0153834 | A1 | 5/2019 | Latimer | |
| 2021/0140299 | A1 | 5/2021 | Dahl | |
| 2022/0316321 | A1* | 10/2022 | Gagliano | G06N 20/00 |
| 2022/0373176 | A1 | 11/2022 | Al-Shaiji | |
| 2023/0020417 | A1* | 1/2023 | Elbsat | G06Q 10/06313 |
| 2023/0193743 | A1 | 6/2023 | Katterbauer et al. | |
| 2023/0272692 | A1 | 8/2023 | Tucker | |
| 2023/0323755 | A1 | 10/2023 | Al-Qasim | |
| 2023/0399938 | A1 | 12/2023 | Hernandez de la Bastida | |
| 2024/0410239 | A1 | 12/2024 | Rashid | |
| 2024/0411951 | A1 | 12/2024 | Rashid | |
| 2025/0067146 | A1 | 2/2025 | Theuveny | |
| 2025/0067147 | A1 | 2/2025 | Theuveny | |
| 2025/0163777 | A1 | 5/2025 | Theuveny | |
| 2025/0163800 | A1 | 5/2025 | Bailey | |
| 2025/0264005 | A1 | 8/2025 | Theuveny | |

FOREIGN PATENT DOCUMENTS

| | | | |
|---|---|---|---|
| WO | 2022015516 | A1 | 1/2022 |
| WO | 2022204718 | A1 | 9/2022 |
| WO | 2023102046 | A1 | 6/2023 |

OTHER PUBLICATIONS

International Search Report and Written Opinion issued in the PCT Application No. PCT/US2024/056814 dated Mar. 7, 2025, 10 pages.

International Search Report and Written Opinion issued in the PCT Application No. PCT/US2024/056894 dated Mar. 14, 2025, 14 pages.

Yeo, L. et al., "Optimization of hole cleaning in horizontal and inclined wellbores: A study with computational fluid dynamics", Journal of Petroleum Science and Engineering, 2021, 205, Article 108993, 13 pages.

Osundre, O.S. et al., "Gas-Liquid Flow Regime Maps for Horizontal Pipelines: Predicting Flow Regimes Using Dimensionless Parameter Groups", Multiphase Science and Technology, 2022, 34(4), pp. 75-99.

Amaya-Gomez, R. et al., "Probabilistic approach of a flow pattern map for horizontal, vertical, and inclined pipes", Oil Gas Science and Technology—Rev. IFP Energies nouvelles 74, 2019, Article 67, pp. 1-13.

Bailey, W. J. et al., "Framework for Field Optimization to Maximize Asset Value," SPE-87026-PA, SPE Reservoir Engineering, 2005, 8(1), pp. 7-21.

Bailey, W. J. et al."Forecast Optimization and Value of Information Under Uncertainty", in book: Uncertainty Analysis and Reservoir Modeling, Y.Z. Ma P.R. LaPointe (eds.), AAPG Memoir Series #96, Chapter 14, 27 pages.

Barnea, D. et al., "Holdup of the Liquid Slug in Two-Phase Intermittent Flow," International Journal of Multiphase Flow, 1985, 11(1), pp. 43-49.

Barnea, D. et al., "Void Fraction Measurements in Vertical Slug Flow: Applications to Slug Characteristics and Transition", International Journal of Multiphase Flow, 1989, 15(4), pp. 495-504.

Barnea, D., "A Unified Model for Predicting Flow-Pattern Transitions for the Whole Rangeof Pipe Inclinations," International Journal of Multiphase Flow, 1987, 13(1), pp. 1-12.

Colebrook, C. F. et al., "Experiments with Fluid Friction in Roughened Pipes," Proceedings of the Royal Society Series A: Math. Phys. Sci., London, UK, 1937, 161(906), pp. 367-381.

Colebrook, C.F. "Turbulent Flow in Pipes with particular reference to the Transition Region between Smooth and Rough Pipe Laws," Journal of Institute of Civil Engineering, London, UK, 11, 1938/1939, pp. 133-156.

Dukler, A. E. et al., "A Model for Gas-Liquid Slug Flow in Horizontal and Near Horizontal Tubes," Industrial Engineering Chemistry Fundamentals, 1975, 14(4), pp. 337-347.

Fernandes, R.C. et al., "Hydrodynamic Model for Gas-Liquid Slug Flow in Vertical Tubes," AIChE Journal, 1983, 29 (6), pp. 981-989.

Fernandes, R.C, "Experimental and Theoretical Studies of Isothermal Upward Gas-Liquid Flows in Vertical Tubes", PhD thesis, University of Houston, TX, 1981, 21 pages.

Mukherjee, H. et al., "Empirical Equations to Predict Flow Patterns in Two-Phase Inclined Flow," International Journal of Multiphase Flow, 1985, 11(3), pp. 299-315.

Raghuraman, B. et al., "Valuation of Technology and Information for Reservoir Risk Management," SPE-86568, SPE Reservoir Engineering, 2003, 6(5), pp. 307-316.

Rashid, K. et al., "An adaptive multiquadric radial basis function method for expensive black-box mixed-integer nonlinear constrained optimization", Engineering Optimization, 2013, 45(2), pp.

Reynolds, O., "An Experimental Investigation of the Circumstances Which Determine Whether the Motion of Water Shall Be Direct Or Sinuous, and of the Law of Resistance in Parallel Channels", Philosophical Transactions of The Royal Society, 174, 1883, pp. 935-982.

Sylvester, N. D., "A Mechanistic Model for Two-Phase Vertical Slug Flow in Pipes," Journal of Energy Resources Technology, Transactions, ASME, 1987, 109(4), pp. 206-213.

Taitel, Y. et al., "A Consistent Approach for Calculating Pressure Drop in Inclined Slug Flow," Chemical Engineering Science, 1990, 45(5), pp. 1199-1206.

Taitel, Y. et al., "Two-Phase Slug Flow", Advances in Heat Transfer, 1990, 20, pp. 83-132.

Taitel, Y. et al., "A Model for Predicting Flow Regime Transitions in Horizontal and Near Horizontal Gas-Liquid Flow," AIChE Journal, 1976, 22(1), pp. 47-55.

Vo, D. T. et al., "A Note on the Existence of a Solution for Two-Phase Slug Flow in Vertical Pipes," Journal of Energy Resources Technology, Transactions of the ASME, 1989, pp. 64-65 plus Errata published in the same journal in Dec. 1989, p. 213, correcting several errors present in the original.

Yildirim, G. et al., "Computer-based analysis of explicit approximations to the implicit Colebrook-White equation in turbulent flow friction factor calculation," Advances in Engineering Software, 2009, 40(11), pp. 1183-1190.

Office Action issued in U.S. Appl. No. 18/333,342 dated Jun. 17, 2024, 7 pages.

Combined Search and Exam Report issued in United Kingdom Patent Application No. GB2408399.0 dated Oct. 28, 2024, 10 pages.

Office Action issued in U.S. Appl. No. 18/333,342 dated Nov. 13, 2024, 6 pages.

Combined Search and Exam Report issued in United Kingdom Patent Application No. GB2408398.2 dated Nov. 27, 2024, 5 pages.

Combined Search and Exam Report issued in United Kingdom Patent Application No. GB2412311.9 dated Jan. 22, 2025, 6 pages.

Al-Safran, E. et al., "High-Viscosity Liquid/Gas Flow Pattern Transitions in Upward Vertical Pipe Flow", SPE Journal, 2020, 19 pages.

* cited by examiner

REDUCING $CO_2$ EMISSIONS DURING A WELLBORE CLEAN-UP

FIELD OF THE INVENTION

This disclosure relates generally to hydrocarbon production and exploration and, more particularly, to methods and apparatuses to monitor $CO_2$ emissions during wellbore clean-up operations.

BACKGROUND INFORMATION

Wellbores may be drilled into subsurface rocks to create wells to access subterranean fluids, such as hydrocarbons, stored in subterranean formations. When these subterranean fluids are produced from the wells, it may be desirable to obtain certain characteristics of the produced fluids to facilitate efficient and economic exploration and production. For example, it may be desirable to obtain flow rates and/or other characteristics of the produced fluids. These produced fluids are often multiphase fluids (e.g., having some combination of water, oil, and gas).

Well clean-up is an initial phase of a well test and begins with opening the well. During this phase, non-reservoir fluids, such as completion, drilling, and stimulation fluids, are produced to the surface together with reservoir fluids. At this stage, the effluent composition may be at least partially unknown, and the flow can be unstable and characterized by a slug flow. The clean-up phase may vary from scenario to scenario and facility to facility and for different objective functions. Thus, a single clean-up flow plan may not be suitable for all scenarios, facilities, and objective functions. Furthermore, tracking $CO_2$ emissions may be difficult due to the various factors/parameters in such computations being derived from different simulator types.

SUMMARY

A summary of certain embodiments described herein is set forth below. It should be understood that these aspects are presented merely to provide the reader with a brief summary of these certain embodiments and that these aspects are not intended to limit the scope of this disclosure.

In one embodiment, a system includes a mixer configured to mix air and hydrocarbons and a burner configured to receive the mixed air and hydrocarbons and to generate syngas. The system also includes a cooling system configured to receive the syngas and to cool the syngas to form cooled syngas. The system further includes a collector configured to collect carbon from the cooled syngas as soot. Moreover, the system includes a flare stack configured to receive the cooled syngas and to burn off at least part of the cooled syngas.

In another embodiment, a method includes receiving one or more sets of parameters related to an operation corresponding to a wellbore. At a first time, simulating at least a portion of the operation using the one or more sets of parameters to determine $CO_2$ emissions during the operation and recording pertinent results from the simulation. The method also includes storing results comprising the $CO_2$ emissions for the operation in a table and at a second time, retrieving the determined $CO_2$ emissions from the table. Moreover, the method includes using the determined $CO_2$ emissions to control the operation.

In a further embodiment, a system includes a throat and nozzle system configured to mix air and hydrocarbons. The system also includes a burner configured to receive the mixed air and hydrocarbons from the throat and nozzle system and to generate syngas. Moreover, the system includes an air cooler configured to receive the syngas and to cool the syngas to form cooled syngas. The system further includes a collector configured to collect carbon from the cooled syngas as soot and a flare stack configured to receive the cooled syngas and to burn off at least part of the cooled syngas. Furthermore, the system includes a heat exchanger located between the air cooler and the collector to control a temperature of the flare stack.

BRIEF DESCRIPTION OF THE DRAWINGS

Various aspects of this disclosure may be better understood upon reading the following detailed description and upon reference to the drawings, in which.

DETAILED DESCRIPTION

Figure 1:
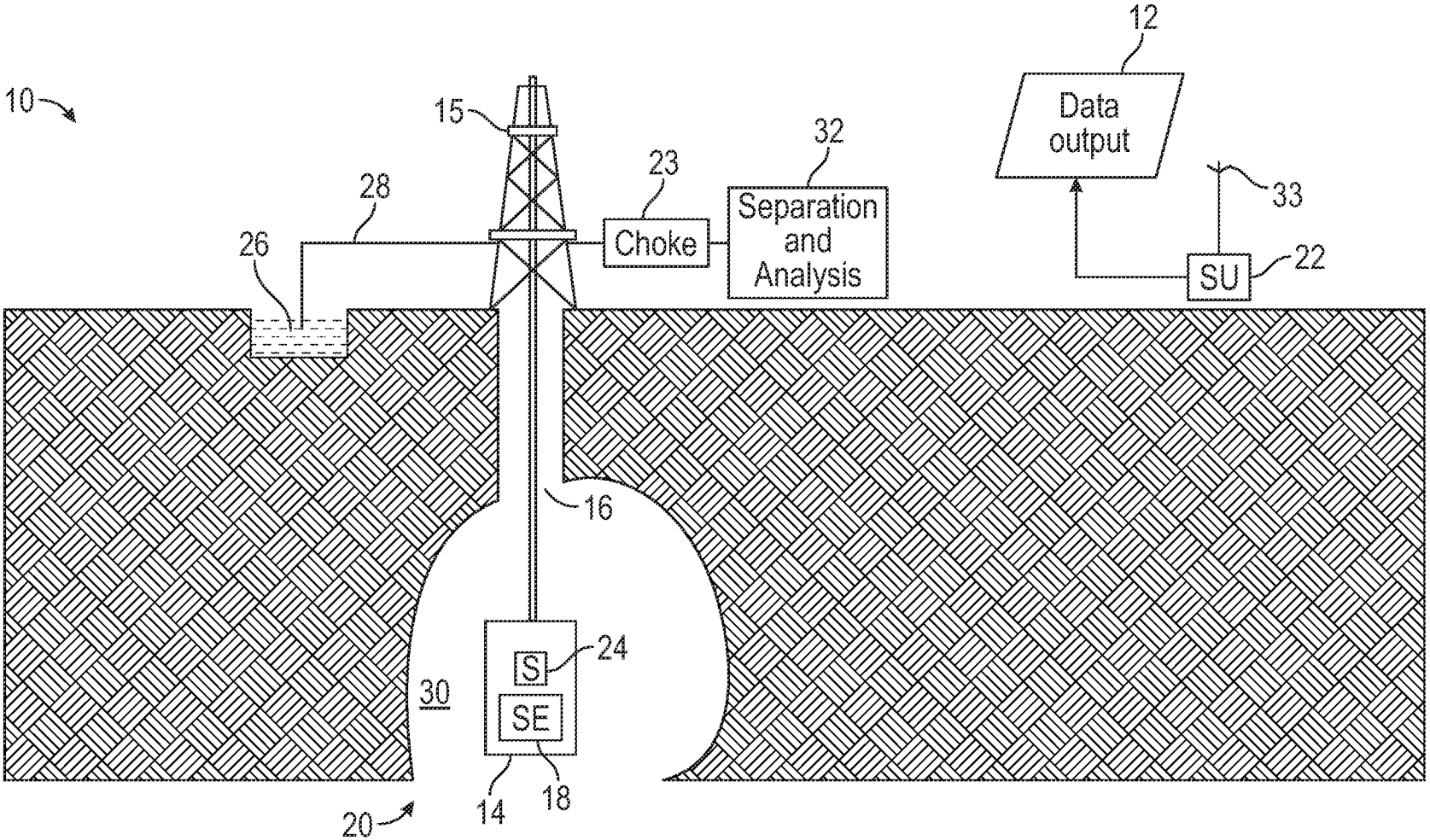
FIG. 1 illustrates a diagram of a data capturing system used to capture data in and/or around an oilfield, such as in a wellbore, in accordance with embodiments of the present disclosure.

In the following, reference is made to embodiments of the disclosure. It should be understood, however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments, and advantages are merely illustrative and are not considered elements or limitations of the claims except where explicitly recited in a claim. Likewise, reference to "the disclosure" shall not be construed as a generalization of inventive subject matter disclosed herein and should not be considered to be an element or limitation of the claims except where explicitly recited in a claim.

Although the terms first, second, third, etc., may be used herein to describe various elements, components, regions, layers and/or sections, these elements, components, regions, layers and/or sections should not be limited by these terms. These terms may be only used to distinguish one element, component, region, layer or section from another region, layer, or section. Terms such as "first," "second" and other numerical terms, when used herein, do not imply a sequence or order unless clearly indicated by the context. Thus, a first element, component, region, layer, or section discussed herein could be termed a second element, component, region, layer, or section without departing from the teachings of the example embodiments.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Some embodiments will now be described with reference to the figures. Like elements in the various figures will be referenced with like numbers for consistency. In the following description, numerous details are set forth to provide an understanding of various embodiments and/or features. It will be understood, however, by those skilled in the art, that some embodiments may be practiced without many of these details, and that numerous variations or modifications from the described embodiments are possible. As used herein, the terms "above" and "below," "up" and "down," "upper" and "lower," "upwardly" and "downwardly," and other like terms indicating relative positions above or below a given point are used in this description to more clearly describe certain embodiments. Furthermore, "optimize" as used herein is intended to cover scenarios where certain objectives/parameters are enhanced or improved even if there may be further improvement available. In other words, an operation may be optimized without being the most optimized possible solution.

During the clean-up period of a well test, various operations may be implemented. For instance, pre-job wellhead surface equipment optimization may be implemented for a wellbore clean-up to maximize some objective function, F. For instance, F may non-exclusively include a function to maximize clean-up quality in a least amount of time, minimize $CO_2$ emissions, minimize an amount of area occupied by wellhead equipment and connections, minimize sound emission, and/or other suitable functions that may be used.

With the foregoing in mind, FIG. 1 illustrates a data capturing system 10 to capture and produce data output 12 in an oilfield that is captured as part of a clean-up operation, wireline operation, pumping operation, drilling operation, extraction operation, or any other operation being performed. In the illustrated embodiment, the data capture is being at least partially performed by a wireline tool 14 suspended by a rig 15 and into a wellbore 16 during drilling. During production/clean-out, data may be acquired using other tools (e.g., surface measurements). The wireline tool 14 is adapted for deployment into wellbore 16 for generating well logs, performing downhole tests, collecting samples, and/or collecting any other data. For instance, the wireline tool 14 may assist in performing a logging while drilling (LWD) operation. Additionally or alternatively, the wireline tool 14 may, for example, have an explosive, radioactive, electrical, or acoustic energy source 18 that sends and/or receives electrical signals to surrounding subterranean formations 20 and/or fluids therein. Return signals may be detected using the wireline tool 14 and/or other tools located at other locations at/near the oilfield.

Computer facilities may be positioned at various locations about the oilfield (e.g., the surface unit 22) and/or at remote locations. The surface unit 22 may be used to communicate with the wireline tool 14 and/or offsite operations, as well as with other surface or downhole sensors. The surface unit 22 is capable of communicating with the wireline tool 14, pumps, a choke 23, and/or other equipment. For instance, the choke 23 may be an adjustable choke that controls fluid flow out of the wellbore. The surface unit 22 may also collect data generated during the drilling operation, clean-out operation, production operation, and/or logging and produces data output 12, which may then be stored or transmitted. In other words, the surface unit 22 may collect data generated during the clean-out operation and may produce data output 12 that may be stored or transmitted.

The surface unit 22 may include one or more various sensors and/or gauges that may additionally or alternatively be located at other locations in the oilfield. These sensors and/or gauges may be positioned about the oilfield (e.g., in/at the rig 15) to collect data relating to various field operations. As shown, at least one downhole sensor 24 is positioned in the wireline tool 14 to measure downhole parameters which relate to, for example porosity, permeability, fluid composition and/or other parameters of the field operation. During drilling, different or more parameters, such as weight on bit, torque on bit, pressures, temperatures, flow rates, compositions, rotary speed, and/or other parameters of the field operation, may be measured.

The surface unit 22 may include a transceiver 33 to enable communications between the surface unit 22 and various portions of the oilfield or other locations. The surface unit 22 may also be provided with or functionally connected to one or more controllers for actuating mechanisms at the oilfield. The surface unit 22 may then send command signals to the oilfield in response to data received. The surface unit 22 may receive commands via the transceiver 33 or may itself execute commands to the controller. A computing system including a processor may be included to analyze the data (locally or remotely), make decisions, control operations, and/or actuate the controller. In this manner, the oilfield may be selectively adjusted based on the data collected. This technique may be used to enhance portions of the field operation, such as controlling drilling, weight on bit, pump rates, and/or other parameters. These adjustments may be made automatically based on an executing application with or without user input.

A mud pit 26 is used to draw drilling mud into the drilling tools via flow line 28 for circulating drilling mud down through the drilling tools, then up wellbore 16 and back to the surface. The drilling mud may be filtered and returned to the mud pit 26. A circulating system may be used for storing, controlling, or filtering the flowing drilling muds. The drilling tools are advanced into subterranean formations 20 to reach a reservoir 30. Each well may target one or more reservoirs.

Generally, the wellbore 16 is drilled according to a drilling plan that is established prior to drilling. The drilling plan sets forth equipment, pressures, trajectories and/or other parameters that define the drilling process for the wellsite. The drilling operation may then be performed according to the drilling plan. However, as information is gathered, the drilling operation may need to deviate from the drilling plan. Additionally, as drilling or other operations are performed, the subsurface conditions may change. The earth model may also be adjusted as new information is collected.

After the drilling operation is completed, at least some drilling mud and/or other materials other than the desired subterranean fluid may remain in the wellbore. To remove these unwanted materials, a clean-up operation may be performed. As effluent travel upwards through the wellbore 16, it travels through the choke 23. As previously noted, this effluent may be multiphase consisting of multiple fluids (e.g., oil, gas, and water). This multiphase fluid traverses the choke 23 and enters into a separation and analysis system 32. The separation and analysis system 32 may be at least partially included in the surface unit 22. The separation and analysis system 32 may include a horizontal separator, a vertical separator, and/or any other mechanisms that may facilitate separation of the incoming effluent. For instance, the separator may include a 3-phase gravity separator that separates the effluent into its separate gas, oil, and water sub-elements. The analysis portion of the separation and analysis system 32 may evaluate how successful the separation of the sub-elements has been. Additionally or alternatively, the analysis portion of the separation and analysis system 32 may determine flow rates of water and other liquids to determine whether the clean-up has been completed. Additionally, if the effluent contains solids, the analysis portion of the separation and analysis system 32 may determine the value of basic sediments and water (BSW) in the effluent to determine whether the clean-up operation has been completed.

The data gathered by sensors 24 may be collected by the surface unit 22 and/or other data collection sources for analysis or other processing. The data collected by the sensors 24 may be used alone or in combination with other data. The data may be collected in one or more databases and/or transmitted to another location on-site or offsite. The data may be historical data, real time data, or combinations thereof. The real time data may be used in real time or stored for later use. The data may also be combined with historical data and/or other inputs for further analysis. The data may be stored in separate databases and/or combined into a single database.

Figure 2:
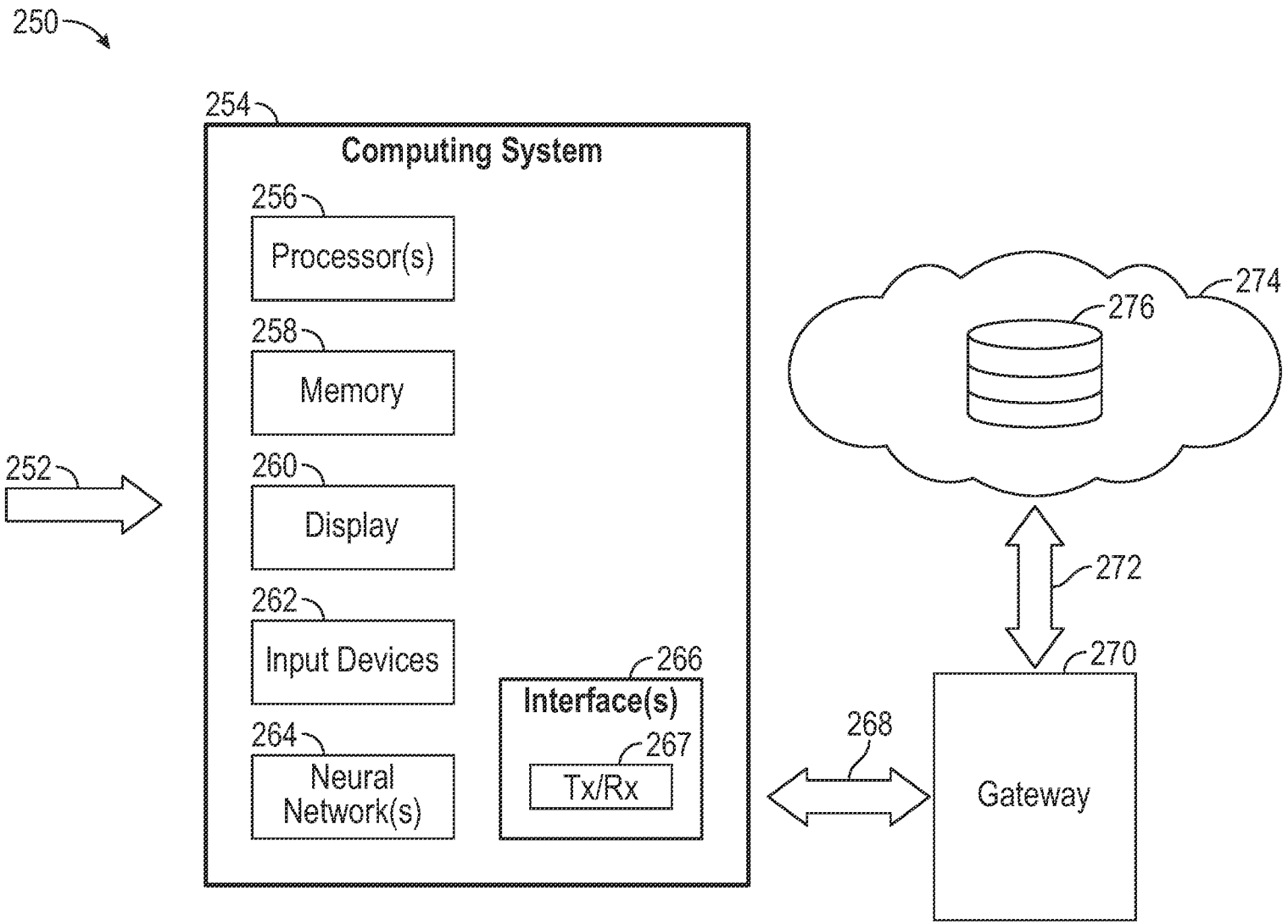
FIG. 2 illustrates a computing system used to process data from the data capturing system of FIG. 1, in accordance with embodiments of the present disclosure.

FIG. 2 is a block diagram of a system 250 that may be used for analyzing/utilizing the data output 12 from the data capturing system 10, as described in FIG. 1. The data output 12, as described in FIG. 1, is received as input data 252 at a computing device 254. The computing device 254 may be implemented in the surface unit 22 and/or may be implemented at other locations within the oilfield or remotely from the oilfield where the remote locations are able to receive the data via the transceiver 33. The various functional blocks shown in FIG. 2 may include hardware elements (including circuitry), software elements (including computer code stored on a tangible computer-readable medium), or a combination of both hardware and software elements. It should be noted that FIG. 2 is merely one example of a particular implementation and is intended to illustrate the types of components that may be present in the computing device 254.

As illustrated, the computing device 254 includes one or more processor(s) 256, a memory 258, a display 260, input devices 262, one or more neural network(s) 264, and one or more interface(s) 266. In the computing device 254, the processor(s) 256 may be operably coupled with the memory 258 to facilitate the use of the processor(s) 256 to implement various stored programs. Such programs or instructions executed by the processor(s) 256 may be stored in any suitable article of manufacture that includes one or more tangible, computer-readable media at least collectively storing the instructions or routines, such as the memory 258. The memory 258 may include any suitable articles of manufacture for storing data and executable instructions, such as random-access memory, read-only memory, rewritable flash memory, hard drives, and optical discs. In addition, programs (e.g., an operating system) encoded on such a computer program product may also include instructions that may be executed by the processor(s) 256 to enable the computing device 254 to provide various functionalities.

The input devices 262 of the computing device 254 may enable a user to interact with the computing device 254 (e.g., pressing a button to increase or decrease a volume level). The interface(s) 266 may enable the computing device 254 to interface with various other electronic devices. The interface(s) 266 may include, for example, one or more network interfaces for a personal area network (PAN), such as a Bluetooth network, for a local area network (LAN) or wireless local area network (WLAN), such as an IEEE 802.11x Wi-Fi network or an IEEE 802.15.4 wireless network, and/or for a wide area network (WAN), such as a cellular network. The interface(s) 266 may additionally or alternatively include one or more interfaces for, for example, broadband fixed wireless access networks (WiMAX), mobile broadband Wireless networks (mobile WiMAX), and so forth.

In certain embodiments, to enable the computing device 254 to communicate over the aforementioned wireless networks (e.g., Wi-Fi, WiMAX, mobile WiMAX, 4G, LTE, and so forth), the computing device 254 may include a transceiver (Tx/Rx) 267. The transceiver 267 may include any circuitry that may be useful in both wirelessly receiving and wirelessly transmitting signals (e.g., data signals). The transceiver 267 may include a transmitter and a receiver combined into a single unit.

The input devices 262, in combination with the display 260, may allow a user to control the computing device 254. For example, the input devices 262 may be used to control/initiate operation of the neural network(s) 264. Some input devices 262 may include a keyboard and/or mouse, a microphone that may obtain a user's voice for various voice-related features, and/or a speaker that may enable audio playback. The input devices 262 may also include a headphone input that may provide a connection to external speakers and/or headphones.

The neural network(s) 264 may include hardware and/or software logic that may be arranged in one or more network layers. In some embodiments, the neural network(s) 264 may be used to implement machine learning and may include one or more suitable neural network types. For instance, the neural network(s) 264 may include a perceptron, a feed-forward neural network, a multi-layer perceptron, a convolutional neural network, a long short-term memory (LSTM) network, a sequence-to-sequence model, and/or a modular neural network. In some embodiments, the neural network(s) 264 may include at least one deep learning neural network.

The output of the neural network(s) 264 may be based on the input data 252, such as flow rates or other data captured during drilling, clean-out, and/or other operations. This output may be used by the computing device 254. Additionally or alternatively, the output from the neural network(s) 264 may be transmitted using a communication path 268 from the computing device 254 to a gateway 270. The communication path 268 may use any of the communication techniques previously discussed as available via the interface(s) 266. For instance, the interface(s) 266 may connect to the gateway 270 using wired (e.g., Ethernet) or wireless (e.g., IEEE 802.11) connections. The gateway 270 couples the computing device 254 to a wide-area network (WAN) connection 272, such as the Internet. The WAN connection 272 may couple the computing device 254 to a cloud network 274. The cloud network 274 may include one or more computing devices 254 grouped into one or more locations (e.g., data centers). The cloud network 274 includes one or more databases 276 that may be used to store the output of the neural network(s) 264. In some embodiments, the cloud network 274 may perform additional transformations on the data using its own processor(s) 256 and/or neural network(s) 264.

Figure 3:
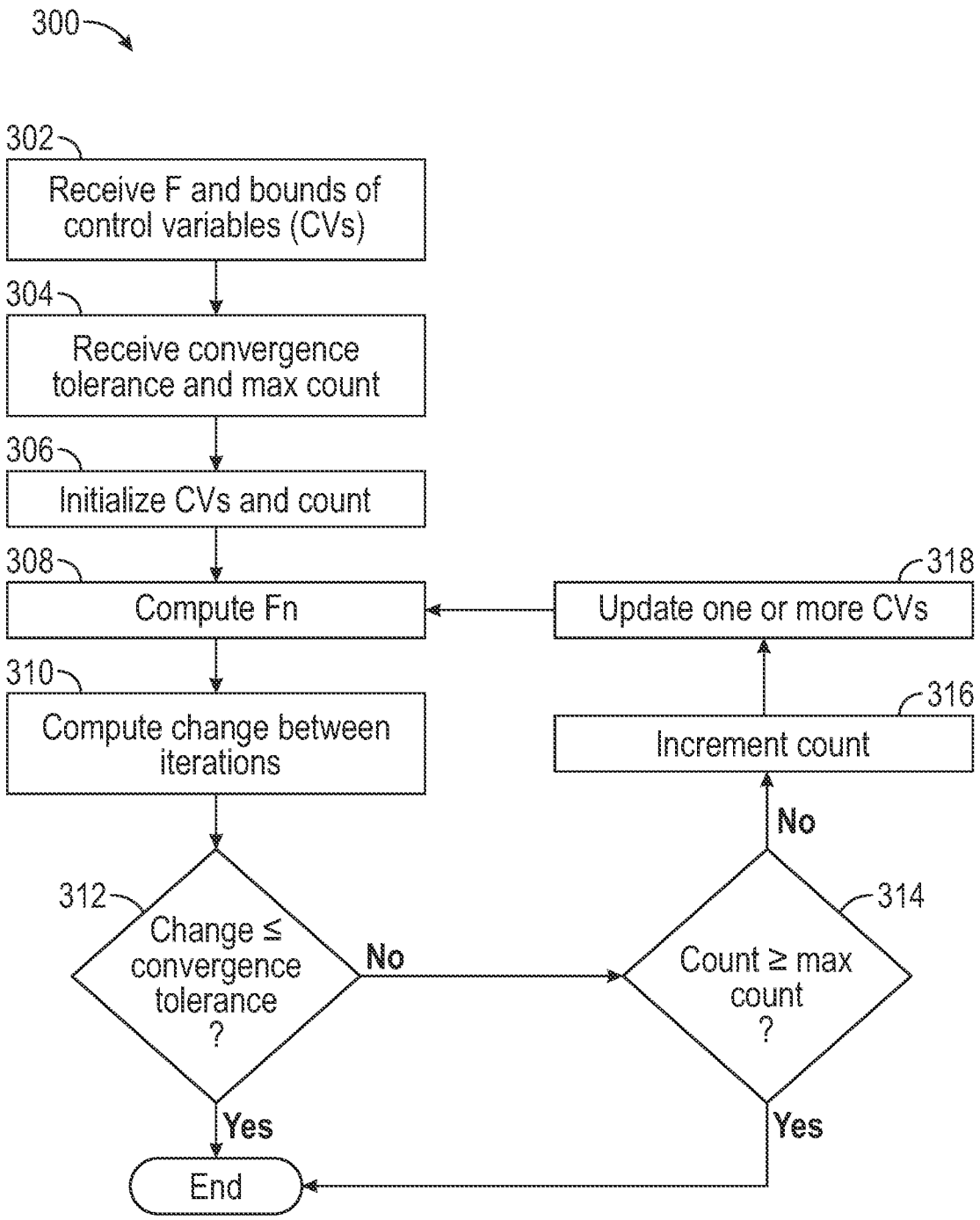
FIG. 3 illustrates a process for performing a deterministic optimization for a clean-up operation of the wellbore, in accordance with embodiments of the present disclosure.

The computing device 254 may be used to perform an optimization process to optimize for the objective function, F. For instance, FIG. 3 is a block diagram of a process 300 for performing a deterministic optimization that may be performed using the computing device 254. As illustrated, the computing device 254 receives F and bounds of control variables (CVs) (block 302). For instance, F may be received as defined by a user via the input devices 262, pulled from the memory 258, received as a selection from presented possible functions, and/or other mechanisms suitable for defining the objective function, F. Similarly, the bounds for the CVs may be defined and/or received by the computing device 254. Furthermore, the computing device 254 receives a convergence tolerance and max count (block 304). The convergence tolerance and/or the max count may be defined similarly to how the CVs and/or F is received. The convergence tolerance and/or the max count control how many iterations are to be performed. A larger convergence tolerance deems the optimization converged or optimized at an earlier time while the max count defines a maximum number of iterations before the optimization using the process 300 is halted. In other words, a higher threshold condition will be met earlier than a lower one.

The computing device 254 initializes the CVs and a count (block 306). For instance, the count may set an index (e.g., n) for values (e.g., x) to a first value (e.g., $x_{n=1}$). Using these CV values, the computing device 254 computes a corresponding F for the count (e.g., $F_n$) (block 308). As is described below in further detail, the computation of the corresponding F using the CV values may be calculated using coupled emulators that perform a "trial" using the CVs in tandem. The computing device 254 may determine a maximum change from a maximum of the previous iteration (e.g., initially set to some default value, such as undefined) (block 310). For instance, the computing device 254 may determine a maximum change of the corresponding F and a previously computed F (or undefined value).

The computing device 254 may then determine whether the change is less than or equal to the convergence tolerance (block 312). For instance, the computing device 254 may subtract the corresponding function from the max of the previous iteration. If the absolute value of the difference is less than or equal to the convergence tolerance, the corresponding function may be deemed "optimized," and the process 300 may end.

If the difference is not less than or equal to the convergence tolerance, the computing device 254 may determine whether the maximum count, as previously defined, has been reached (block 314). If the max count has been reached, the computing device 254 may end the process 300. If the count is less than the maximum count, the computing device 254 increments the count (block 316). The computing device 254 then updates the CVs (e.g., $x_n$) based on the incremented count (block 318). With the updated CVs, the computing device 254 may re-compute the new corresponding function F, and the process 300 starts over from block 308.

Figure 4:
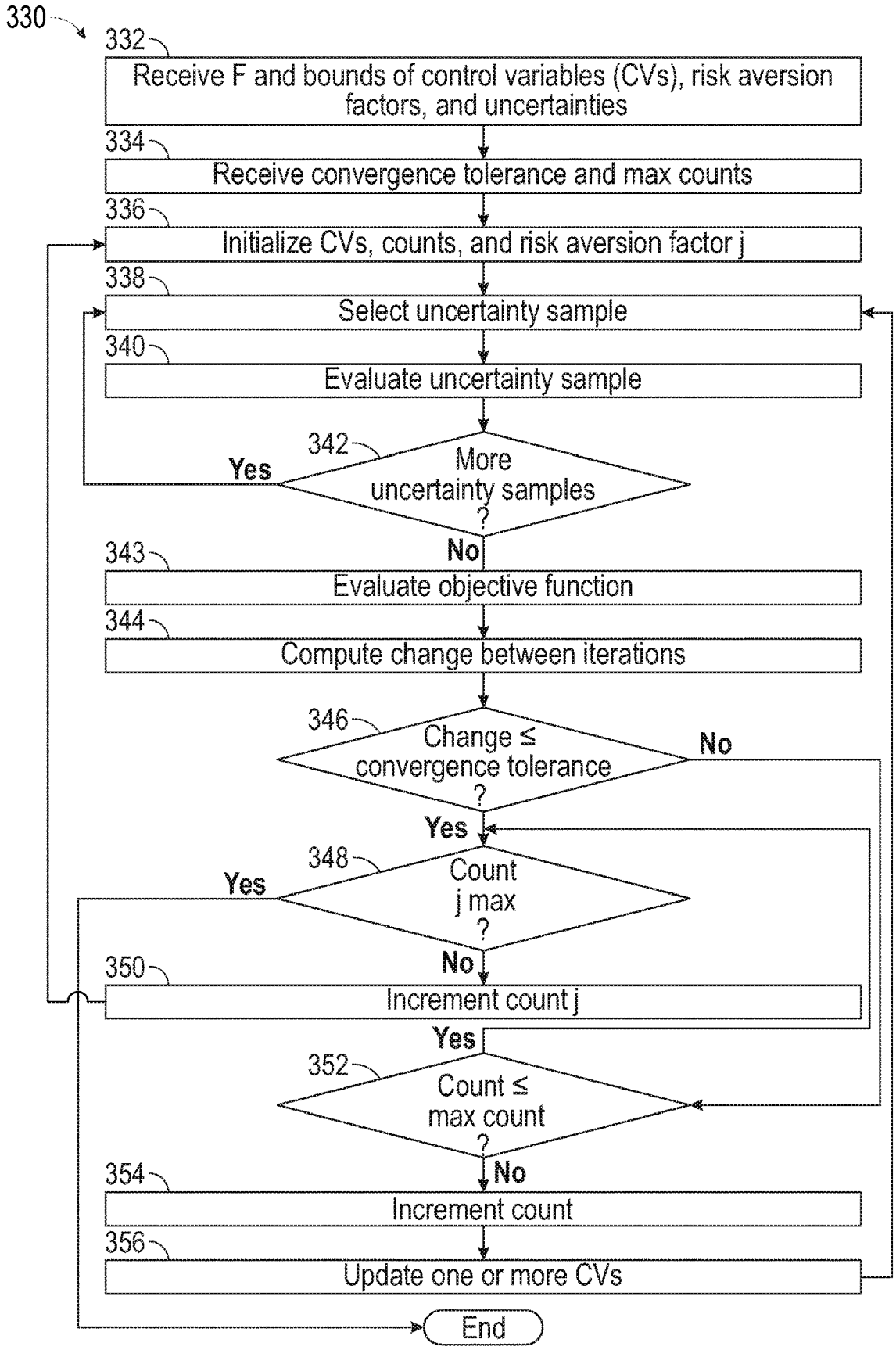
FIG. 4 illustrates a process for performing an optimization for a clean-up operation of the wellbore with at least one uncertainty, in accordance with embodiments of the present disclosure.

FIG. 4 is a flow chart of a process 330 that is an optimization with one or more uncertainty samples using the computing device 254. Such uncertainty may be related to static reservoir 30 properties, depth, and severity of fluid invasion in the near wellbore region, and/or layer-specific productivity indexes. As illustrated, the computing device 254 receives F, bounds of control variables (CVs), risk aversion factors, and one or more uncertainties (e.g., $U_1$, $U_2$, . . . $U_K$) (block 332). Furthermore, the computing device 254 receives a convergence tolerance and max counts (block 334). The function F, bounds of CVs, the risk aversion, the one or more uncertainty samples, the convergence tolerance, and/or the max count may be received/determined in any of the methods discussed above in relation to the function F, the bounds of the CV, the convergence tolerance, or the max count in relation to FIG. 3. Specifically, in some embodiments, the risk aversion may be a user-defined risk aversion used to indicate how much risk to take during the optimization and may be any positive value (e.g., 0-3). If the risk aversion factor is 0, the optimization may be for the mean, but at a higher value (e.g., 1), the optimization may be for some number greater than the mean in the likelihood of obtaining the value of F or higher.

As previously described, the convergence tolerance and/or the max count control how many iterations are to be performed. As previously noted, a larger convergence tolerance deems the optimization converged or optimized at an earlier time while the max count defines a maximum number of iterations before the optimization using the process 330 is halted. The block 334 may be similar to the block 302 except that there are additional counts. A count (e.g., count j) may be used to index risk aversion factors to enable computing F for different risk aversion factors. Another count (e.g., count s) may be used to index uncertainty samples to enable computing F for multiple uncertainty samples. Each of the counts may be used with their own max counts.

The computing device 254 initializes the CVs, counts, and risk aversion factor j (block 336) similar to block 306. The computing device 254 selects one uncertainty value/sample ($U_k$) from the uncertainty samples using the count (block 338). Using these CV values, the risk aversion factor, and the selected uncertainty sample, the computing device 254 computes a corresponding F for the count (e.g., $F_n$) (block 340). As previously noted, and as is described in further detail below, the computation of the corresponding F using the CV values, risk aversion factor, and selected uncertainty sample may be calculated using coupled emulators that perform a "trial" using the CVs in tandem. The computing device 254 then determines whether there are more uncertainty samples to be used for the set of CVs (block 342). If more uncertainty samples are to be used, the computing device 254 selects another uncertainty sample (e.g., $U_1$) (block 338) and computes an alternative corresponding function (block 340).

If there are no more uncertainty samples, the objective function is to be evaluated (block 343). $F=\mu-\lambda\sigma$ is a generic optimization under uncertainty measure where $\mu$ is the mean and $\sigma$ is a standard deviation. Using the CV values and corresponding uncertainty samples, the computing device 254 may determine a maximum change from a maximum of the previous iterations (e.g., initially set to some default value, such as undefined) (block 344). Furthermore, this computation may be based on the risk aversion factor with $F(x_n|\lambda_j, U)=\mu(x_n|U)-\lambda_j\sigma(x_n|U)$, wherein $x_n$ are the CVs, $\lambda_j$ is the risk aversion factor indexed with count j.

The computing device 254 may then determine whether the change is less than or equal to the convergence tolerance (block 346). For instance, the computing device 254 may subtract the corresponding function from the value of the previous iteration. If the absolute value of the difference is less than or equal to the convergence tolerance, the corresponding function may be deemed "optimized." Once the convergence tolerance is reached, the computing device 254 determines whether the current count j is greater than a count j max (block 348). If the count j has reached its maximum number, the process 330 ends. If the count j has not reached its max, the computing device 254 increments count j (block 350) and proceeds to repeat computations for a different risk aversion factor. In some embodiments, the CVs and/or at least some of the counts may be initialized to a starting point for the new computations.

If the difference is less than the convergence tolerance or the count j has been incremented, the computing device 254 determines whether the maximum count, as previously defined, has been reached (block 352). If the max count has been reached, the computing device 254 may proceed the process 330 to block 348 to check whether the count j max has been reached. If the count is less than the maximum count, the computing device 254 increments the count (block 354). The computing device 254 then updates the CVs (e.g., $x_n$) based on the incremented count (block 356). With the updated CVs, the computing device 254 may re-compute the new corresponding function F, and the process 330 starts over from block 338.

As previously discussed, to ensure correct simulator response for each facility scenario and the associated wellbore clean-up, two or more simulators may be used. Two simulators, a wellbore clean-up simulator, and a commercial process facility simulator, are to be coupled together in a single optimization "trial." In this trial, previously defined CVs are fed into both a wellbore clean-up simulator and (if necessary) commercial process facility simulator to furnish a user-specified objective function, F, in tandem.

Figure 5:
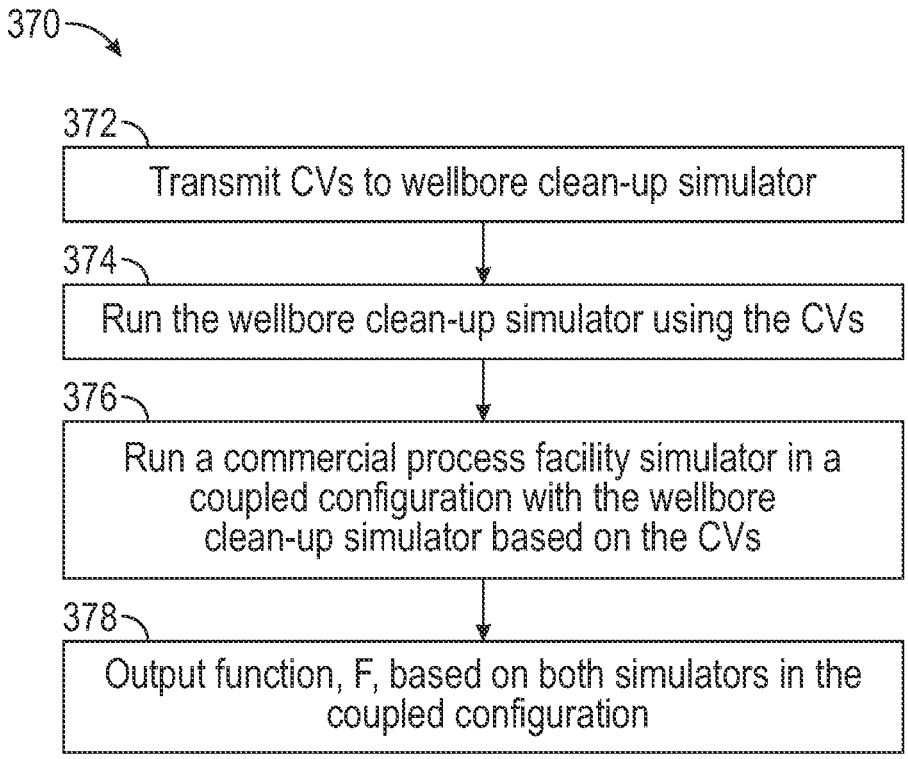
FIG. 5 illustrates a process for computing a function for the processes of FIGS. 3 and 4 using a coupled configuration for two (or more) emulators, in accordance with embodiments of the present disclosure.

Accordingly, FIG. 5 shows a flow chart of an embodiment of a process 370 that may be implemented in the blocks 308 and/or 340. As illustrated, the computing device 254 passes the CVs to a wellbore clean-up simulator (block 372). The computing device 254 may implement the wellbore clean-up simulator or may be coupled to another computing device/cloud that implements the wellbore clean-up simulator as instructions stored in memory and executed by a processor. The computing device 254 causes the wellbore clean-up simulator to be run using the CVs (block 374). The computing device 254 runs or causes the commercial process facility simulator to be run in a coupled configuration with the wellbore clean-up simulator (block 376). The commercial process facility simulator may be implemented as instructions stored in memory and executed by a processor. Furthermore, the commercial process facility simulator may be implemented on a same computing device as the wellbore clean-up simulator or may be implemented on a separate computing device. A coupled configuration, as used herein, indicates that the commercial process facility simulator and the wellbore clean-up simulator are communicatively coupled to share the same CVs, share outputs with each other, or otherwise depend on each other for at least some data in a single, combined trial of an optimization. For instance, the wellbore clean-up simulator may use the CVs in simulation, and the commercial process facility simulator may be used to simulate and control operations in the oilfield or other commercial process facility. The commercial process facility simulator may run simulations based on the CVs by using the CVs directly, using outputs from the wellbore clean-up simulator that were generated based on the CVs, or a combination thereof. The commercial process facility simulator then outputs the computed function F based on both simulators in the coupled configuration (block 378).

Figure 6:
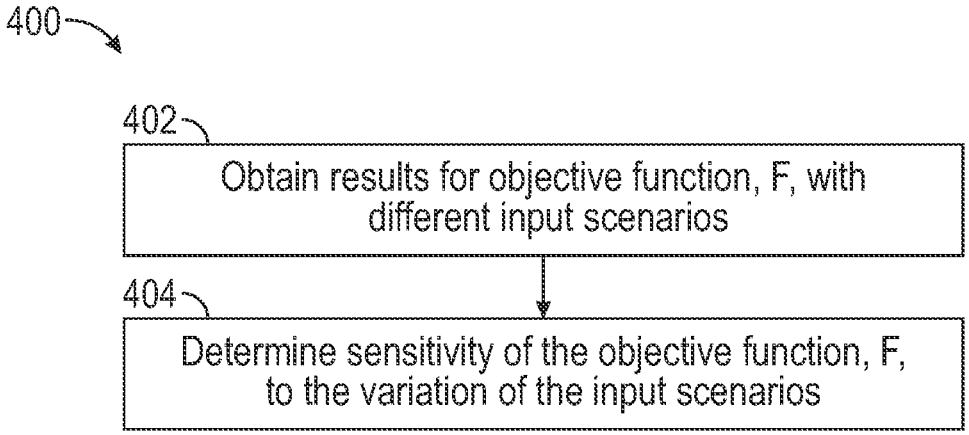
FIG. 6 illustrates a multiple scenario computation using the coupled configuration for two (or more) emulators, in accordance with embodiments of the present disclosure.

Moreover, in some embodiments, the solution accuracy using the process 370 may be enhanced and/or accelerated by performing pre-job sensitivity analysis and identification of key drivers that impact the objective function, F. FIG. 6 shows a block diagram 400 for performing such sensitivity analysis. Using the process 370 and/or real-world measurements, results for the objective function, F, may be obtained with different input scenarios (block 402). The results of the different input scenarios may be compared and used to determine how the different input scenarios impact the results. In other words, the results may be used to determine sensitivity of the objective function to the variation of the input scenarios (block 404).

Additionally or alternatively, history matching (HM) may be used with the process 370 to enable real-time (RT) application of the coupled simulators. In other words, previous results may be HM with RT data to utilize the RT data. HM may include feedback and/or fine-tuning of matches and associated controls, such as those performed using a proportional integral derivative (PID) controller and/or any other feedback-oriented controller types. Practical implementation of any real-time model is contingent upon sufficient compute resources and sufficient simulation controls to enable a match of realized rates and pressures with those predicted. To HM a wellbore clean-up, the wellbore clean-up simulator is to adjust key parameters at any point in time. The quality of HM is established by fitting to outputs, such as well head pressure $P_{WH}$, bottom hole pressure $P_{BH}$, surface gas flow rate $Q_G$, surface oil flow rate $Q_O$, surface mixture flow rate $Q_m$, and the like.

The HM may entail varying various parameters in time to facilitate a fit to historical data. Some parameters, such as reservoir parameters, may be adjustable only at some times (e.g., at initialization) and not at others (e.g., during a wellbore clean-up). Thus, new adjustable parameters may be generated to be adjustable at times that were not previously adjustable. For instance, this new parameter/keyword may be designated as a HM reservoir (HMRES).

The new parameter/keyword may be defined by defining a condition in the wellbore clean-up simulator that indicates that CONSTPRODIDX is specified in the wellbore clean-up simulator and whether a specific parameter (e.g., perforation type) is declared. The new parameter/keyword may also have a defined time that may be coupled to the CONSTPRODIDX and the parameter. Furthermore, a skin factor is multiplied over all layers, and a radius multiplier of zone with damaged permeability is applied over all layers.

Additionally or alternatively, the new parameter/keyword may be defined by defining a condition in the wellbore clean-up simulator that indicates that CONSTPRODIDX is specified in the wellbore clean-up simulator. The new parameter/keyword may also have a defined time that may be coupled to the CONSTPRODIDX. A productivity index (PI) multiplier may be applied over all layers.

In some embodiments, a simple global multiplier, J, may be a part of PI. J operates over all layers declared in the reservoir. In certain embodiments, instead of all multipliers being applied over all zones, at least some zone-specific multipliers may be defined. Furthermore, other parameters in other wellbore clean-up simulator keywords may be eligible candidates as uncertainty samples.

During operations measured data is HM'd to create a proxy of the wellbore clean-up simulator. A proxy of the wellbore clean-up simulator may be a lighter weight approximation of the wellbore clean-up simulator instead of the full-blown model used in the wellbore clean-up simulator. Using this proxy, operations may be optimized for real-time or near-real-time output. One example of the proxy may be a neural network proxy, such as implemented in the neural network(s) 264, or some other form of machine learning proxy. The machine learning proxies use training, but such data suitable for training may be restricted and/or have relatively low amount of data. This is at least partially due to the asset-specific nature of such proxies and that the machine learning proxy is for the specific asset without physics modelling and may be unsuited for forecasting of properties outside the domain of its training for the specific asset. In fact, the machine learning proxy may be directed to a specific outcome, such as $P_{WH}$ or some other parameter. The neural network(s) 264 may include one or more deep or conditional neural networks with any suitable number of hidden layers between input and output layers.

Enhanced Constraint Handling

In some embodiments, different sets of constraints may be used. For instance, simple and complex constraints may be used where simple constraints may be evaluated easily directly either linearly or non-linearly using a mathematical expression. Complex constraints use solutions via the wellbore clean-up simulator that are more complex to determine whether the particular complex constraint has been violated or not. For example, simple constraints may include facility capacity for handling produced gas during a cleanup (flaring limits), facility capacity for handling produced oil during a cleanup (burning), facility capacity for handling produced water during cleanup, specified limits for combined fluids, maximum solids as mass or volumetric flow rate, and/or other constraints. Complex restraints may include complex situations, such as drawdown pressure at a formation that may cause sand production if drawdown is too high, erosional velocity where the pipe is eroded by a choke orifice being too open, and/or other like constraints. Some estimates may be made for complex constraints (e.g., drawdown pressure as a function of flow rate), but since such estimates may be problematic (e.g., drawdown may vary along the length of the wellbore due to wellbore friction and local inflow variations due to rock heterogeneity), some analysis in the wellbore clean-up simulator may be applied causing the constraint to be a complex constraint. In some situations, a simple constraint (e.g., burner and flare operations) may be limited in time. For instance, batch burning may be intermittent or periodic rather than continuous as required by regulations and/or client policy. Similarly, flaring may be permissible only within certain times (e.g., during daylight hours). The time constraints in combination with the simple constraints may be facilitated in the wellbore clean-up simulator similar to complex constraints.

Figure 7:
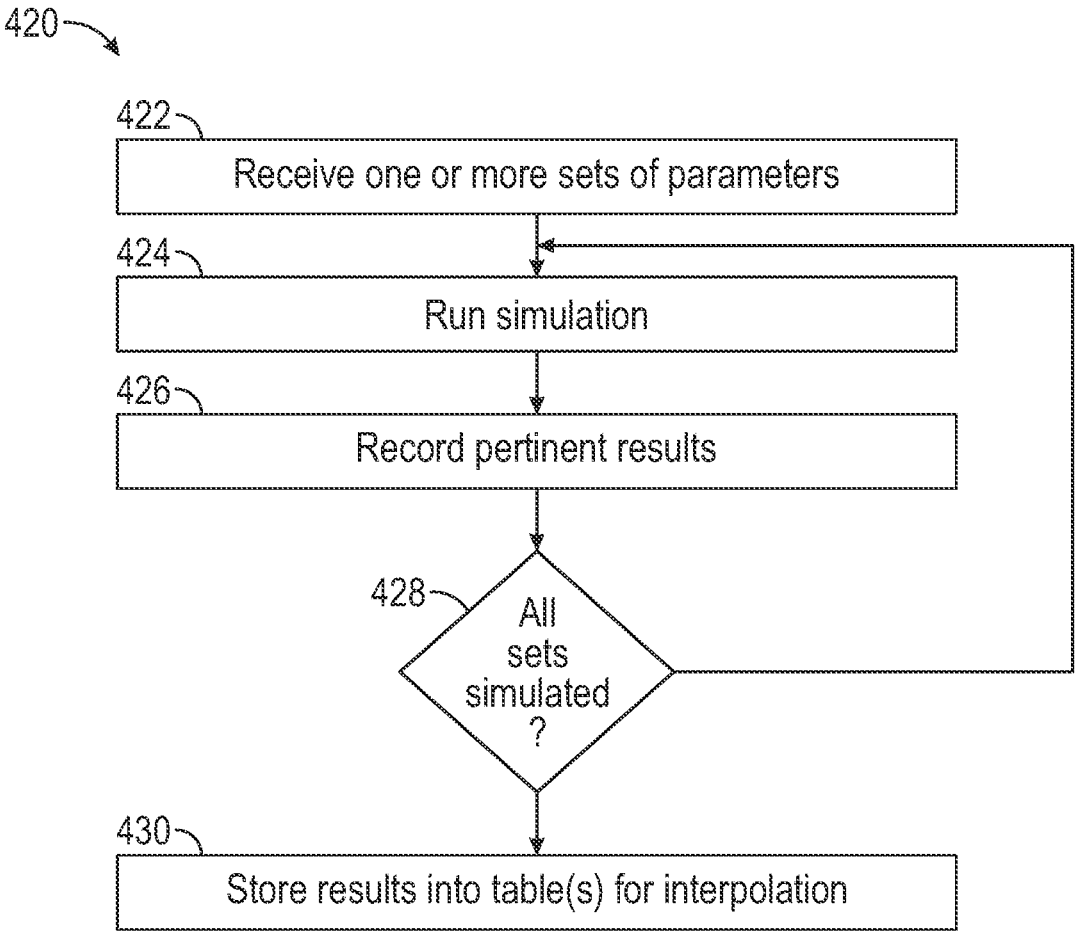
FIG. 7 illustrates a process for performing a priori tabulation of simulations using the coupled configuration of the two (or more) emulators of FIG. 6, in accordance with embodiments of the present disclosure.

At least some of the constraints may be related to environmental factors. For example, the commercial process facility simulator may include a flare simulator that may be used to analyze heat radiation while considering local environment conditions along with targets and/or constraints. For instance, the local environment conditions may include wind speed, wind direction, humidity, ambient temperature, solar radiation, background noise, and/or other relevant local environment conditions. These conditions may be computed using the coupled simulators previously discussed. Additionally or alternatively, at least some a priori tabulation may be used as illustrated in FIG. 7. FIG. 7 shows a flow diagram of a process 420 that may be implemented to perform a priori tabulations of simulations to pre-define complex constraints to avoid potentially computationally expensive fully-coupled simulation. One or more sets of parameter definitions are received that define certain conditions and/or constraints that may be used for simulations (block 422). The sets of parameters may relate to different real world conditions to represent different conditions that may occur for wellbore cleanup operations. In some embodiments, the sets may be defined in dynamic linked libraries that are defined in an input file to the wellbore clean-up simulator for specific modeling aspects, such as different wellbore flow and invasion models. Using a set of the one or more sets, a simulation is run (block 424). For instance, the simulation may be performed using a flare simulator portion of the commercial process facility simulator. Using the simulations, pertinent results are obtained and stored in memory (block 426). When at least one of the sets to be simulated remains (block 428), the process 420 returns to block 424 to run simulations on a different sets of the one or more sets of parameters. When all sets are simulated, the results are stored into one or more tables for interpolation (block 430). The tables may be in any data file (e.g., ASCII, binary, etc.) used to store the information. The tables may be indexed by certain parameters where values between recorded values may be linearly and/or non-linearly interpolated to find values without performing additional and potentially compute-expensive coupled simulations for relatively minor changes in parameters. Additionally or alternatively to the a priori tabulation, at least some of the complex constraints may be computed using simulations in the coupled simulators.

Regardless of using simulations in response to input values and/or using interpolation via the tables resulting from a priori tabulation, input values (e.g., wind speed and direction, etc.) may be used to determine output values (e.g., noise, heat radiation, temperature, etc.).

As noted, an amount of noise (e.g., in dB) emitted from a burner or flare stack may be computed using a priori tabulation and/or simulation to establish whether a result is likely to violate any prescribed noise limits that may be defined by regulation or client policy. Although this is a relatively straightforward constraint to consider during a cleanup operation when a priori tabulation is available, the issue is defining the range of values necessary to generate the aforementioned table as throughputs and equipment types will vary. This issue may be remedied using coupled simulations. Furthermore, in some embodiments, the a priori tabulation tables may be updated when new simulations are run using the coupled simulators.

Figure 8:
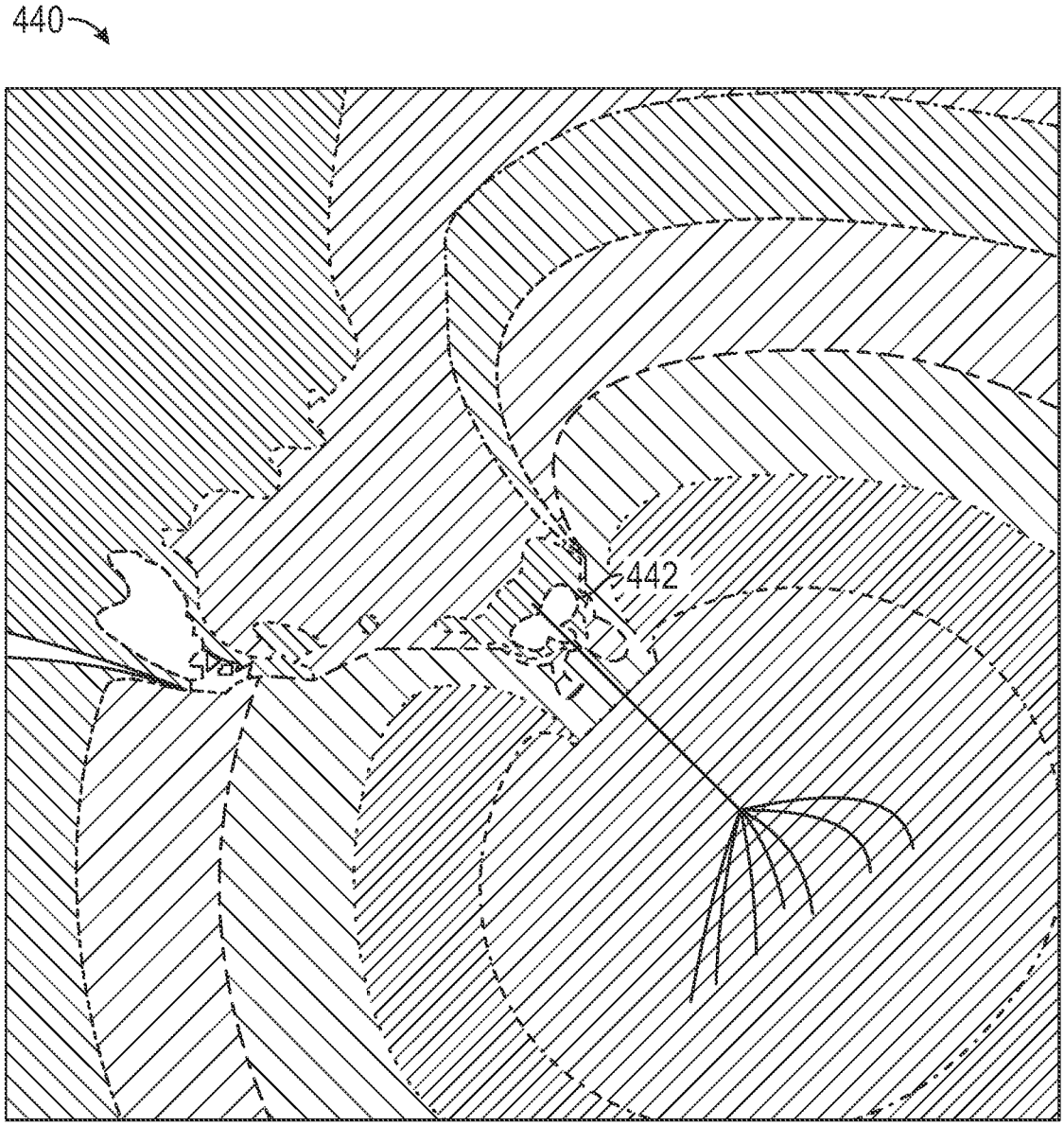
FIG. 8 illustrates an isopleth showing radiation during an operation of the wellbore of FIG. 1, in accordance with embodiments of the present disclosure.

The commercial process facility simulator may also provide information to provide radiation information at specific points. For instance, FIG. 8 shows an embodiment of an isopleth 440 that contains a representative map with a flare stack 442 at the center of the isopleth 440 that shows a contour map of radiation from the flare stack. The flare simulator of the commercial process facility simulator may generate the isopleth 440 using local environmental conditions (e.g., wind speed, wind direction, etc.). In some embodiments, these isopleths may be generated a priori using the process 420 of FIG. 7 using a variety of local environmental conditions. Using these isopleths, temperatures of exposed surfaces for any specific surfaces may be tracked and compared to a threshold value (e.g., defined by regulation, regulatory authorities, and/or customer needs).

Figure 9:
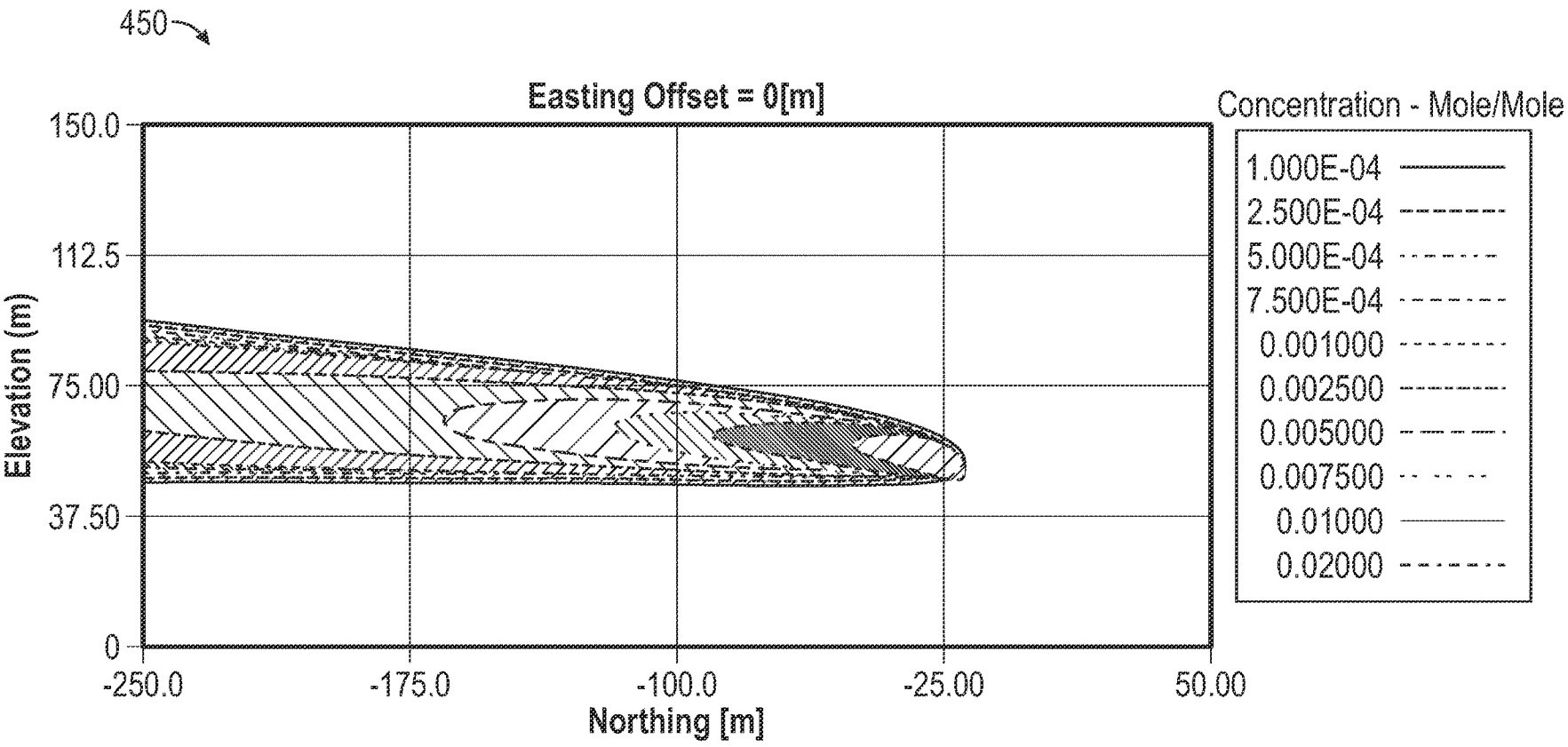
FIG. 9 illustrates an elevation map showing dispersions of emissions during an operation of the wellbore of FIG. 1, in accordance with embodiments of the present disclosure.

Another constraint previously discussed may be dispersion of emissions. The constraint may be that a threshold mole fraction of emission concentrations is not exceeded from a given location. The dispersion of emissions may be shown using a map, similar to the isopleth 440. Additionally or alternatively, the dispersion of emissions may be represented using an elevation map, such as the elevation map 450 of FIG. 9. Such maps may be generated using a priori tabulation and/or coupled simulations using various operating conditions, such as wind speed, wind direction, etc.

The commercial process facility simulator may also be used to evaluate a quantity of assistance fluids for smokeless flare uses as a function of throughput and assign their associated cost to the objective function, F. Such quantities may be computed a priori as a function of composition and throughput and a reasonable cost assigned to better define the objective function, F.

To mitigate some of the aforementioned environmental emissions, the impact of appropriate shielding may be computed from the coupled simulators. Shielding elevates emission limits that may impact a priori tabulation. However, the cost of such shielding may be defined for the objective function, F.

Burner and flare operating time window issues may be at least partially addressed using a new keyword or argument in the wellbore clean-up simulator. For example, the keyword may be called SHUTIN to indicate when a wellbore operation (e.g., cleanup, production, etc.) is delayed, paused, and/or stopped. This may be implemented as an argument in another keyword (e.g., CHOKE) and/or as a dedicated keyword. The insertion of text 'SHUTIN' as an argument may be accompanied by the clock-time duration of the shut-in itself, after which wellbore operation (e.g., clean-up) will recommence. Table 1 below shows an embodiment of SHUTIN used as an argument in the CHOKE keyword.

TABLE 1

| CHOKE keyword with SHUTIN argument | |
|---|---|
| 2 | 48 |
| 8 | SHUTIN |
| 4 | 64 |

In Table 1, there is an eight hour shut-in after two hours of flow with choke set at 48 (e.g., 48/64"). The wellbore clean-up job is then recommenced with four hours of flow with a choke set at 64 (e.g., 64/64 or 1"). If conforming to emission regulations, a specific job-clock keyword may be used, such as CLOCKDATE shown in Table 2.

TABLE 2

| CLOCKDATE keyword | | | |
|---|---|---|---|
| #1 | #2 | #3 | #4 |
| 20:30 | 2024 | 05 | 02 |

The arguments of CLOCKDATE may be defined using Table 3 below:

TABLE 3

| CLOCKDATE keyword | | | |
|---|---|---|---|
| #1 | #2 | #3 | #4 |
| Clock Time 24 hr [hh:mm] | Year [YYYY] | Month [MM] | Day [DD] |

Using Tables 2 and 3 to interpret Table 1 shows that choke defines a shut-in starting at 10:30 pm (i.e., two hours after start of job 8:30 pm (20:30)). The job recommences on May 3 at 6:30 and lasts for four hours (after 8 hours of shut-in).

Wellbore and/or flow modules may be active during shut-in to monitor for gravity segregation and potential fluid ingress back into the near wellbore region. Upon wellbore clean-up recommencement after shut-in, fluid saturation profiles in the well and the near wellbore region may have changed, causing the wellbore clean-up simulator to re-initialize itself accordingly. During shut-in will, by definition, yield zero flow (or emissions) at surface. However, the subsurface system may be in a state of flux with phase segregation, counter-current flow, ingress, and so on. In some embodiments, the shut-in keyword or other similar operation halts, pauses, or delays may be used when one of the constraints (either a priori computed or using coupled simulations) is violated.

Managing Uncertainty

As previously noted in relation to block 340 of FIG. 4, at least some of the uncertainties may be present in simulation and/or computations of the objective function, F. Such uncertainties may be defined in a keyword for the wellbore clean-up simulator, such as RESERVOIR. For instance, some of the uncertain parameters may include the productivity index (PI) or J of the producing layer, volume of fluid invading formation during drilling, depth of invasion, types of solids and depth invading formation, permeability of the zone, porosity of the zone, and/or other factors.

It may be difficult to ascertain which uncertain parameters are the most impactful to the objective function, F, identify their bounds, identify their distributions, and determine how to best sample over these distributions. Furthermore, the issue of sample size may become problematic for standalone applications. However, cloud computing resources of the cloud 274 may be employed to resolve such limitations.

The question of the appropriate number of samples used to define the inherent uncertainty (to a manageable number) is reduced somewhat, though perhaps not completely eliminated through cloud computation. However, such balance between sample size and compute resources may still be desirable/necessary. Thus, a preliminary sensitivity analysis may be performed prior to any operational optimization. The total number of calls to the simulator, N, that is to be used in each trial in the optimization defined by Equation 1:

$$N = \prod_{k=1}^{K} (s_k | U_k) \quad \text{(Equation 1)}$$

K is the total number of uncertainties for the wellbore clean-up problem and $(s_K|U_k)$ are the number of samples necessary to define uncertainty $U_k$. As N is a product, it can become large quickly if $s_k$ and K are not selected carefully even though cloud computing may make computations faster. The uncertainty may be declared for the cleanup operation in the wellbore clean-up simulator using a relevant keyword, such as RESERVOIR and CONSTPRODIDX. For example, Table 4 shows an embodiment of a keyword (e.g., CONSTPRODIDX and/or RESERVOIR) describing two producing zones.

TABLE 4

| Uncertainty declaration in a keyword | | | | | | | | | |
|---|---|---|---|---|---|---|---|---|---|
| #1 | #2 | #3 | #4 | #5 | #6 | #7 | #8 | #9 | #10 |
| 5780 | 6100 | 0.19 | 107 | 310 | 0.17 | 0 | 3.5 | 0.075 | 0.020679 |
| 6198 | 6589 | 0.20 | 95 | 320 | 0.21 | 0 | 3.5 | 0.075 | 0.021534 |

Arguments #1 and #2 are measured depths of top and bottom of completed reservoir zone with argument #3 being porosity. Argument #4 is permeability (k stated in mD). Argument #5 is initial reservoir pressure (Bar) with argument #6 representing initial water saturation, $S_W$ with argument #7 being salt concentration. Argument #8 is the parameter m in the relationship $k=k_0(\phi)^m$ that may typically be a constant. Argument #9 is drilling time (in hours). The meaning of argument #10 may be dependent on whether a specific keyword (e.g., CONSTPRODIDX) is declared or not.

In the example with the specific keyword declared, argument #10 represents productivity index (PI) of the zone (stated in $Sm^3/d/bar$). Using conventional $-delimited declarations for uncertainties we specify two such declaration for PI for both layers, as shown in Table 5 below:

TABLE 5

| Uncertainty declaration in a keyword | | | | | | | | | |
|---|---|---|---|---|---|---|---|---|---|
| #1 | #2 | #3 | #4 | #5 | #6 | #7 | #8 | #9 | #10 |
| 5780 | 6100 | 0.19 | 107 | 310 | 0.17 | 0 | 3.5 | 0.075 | $PIL1$ |
| 6198 | 6589 | 0.20 | 95 | 320 | 0.21 | 0 | 3.5 | 0.075 | $PIL2$ |

According to Table 5, the PI for zone 1 (5780 to 6100 m) is declared as $PIL1$ which is sampled at three equally probable points: Uk=1, with 3 samples {0:020; 0:022; 0:024}. PI for zone 2 (6198 to 6589 m) is declared as $PIL2$, sampled at three equally probable points: Uk=2, with 3 samples {0:019; 0:021; 0:023}. Using Equation 1, we have K=2 thus N=9. In other words, a single trial of the wellbore clean-up simulator will require 9 separate (but perhaps parallel) calls to the wellbore clean-up simulator simulation engine. We then obtain values for $\mu$ and $\sigma$. If there are further uncertainties, such as samples for $\phi$, then Equation 1 soon results in an explosion of samples per trial. For example, 2 additional independent samples for $\phi$ for both zones, then N=36 as K=4, so sK=[3 3 2 2] for k=1-4. In other words, a single trial will require 36 separate (but perhaps parallel) calls of the wellbore clean-up simulator in order to compute with uncertainties. Although uniform grid sampling may be used, non-uniform grid sampling may be instead and/or also used. Indeed, many uncertain parameters may be better addressed using non-uniform sampling schemes. Moreover, all uncertainty samples are to be drawn over the uncertainty space using grid sampling or otherwise.

Minimizing $CO_2$ Emissions

As previously noted, the objective function, F, may include minimizing $CO_2$ emissions in identifying a wellbore clean-up choke schedule. $CO_2$ emissions may be simulated using the commercial process facility simulator and the wellbore clean-up simulator for different situations. For instance, the wellbore clean-up simulator may simulate wellbore invasion and associated damage along with multi-phase fluid flow as a function of surface choke settings, downhole pressure, and saturations. In other words, the wellbore clean-up simulator may model the behavior of fluids in the wellbore as a function of the choke schedule. The commercial process facility simulator may model surface and/or subsurface facilities to compute $CO_2$ emissions for a given input fluid stream as a function of time. For instance, the commercial process facility simulator may be used to derive information about energy consumption of equipment in terms of equivalent $CO_2$ emissions, emissions emanating from gas flaring, and/or emissions emanating from burning of liquid hydrocarbon. Additional emissions considerations may be tracked, such as those related to transportation of equipment to the wellhead, set-up, testing, and/or other information. For instance, such information may be estimated (based on number of loads/vehicles/trip lengths), simulated (based on number of loads/vehicles/trip lengths), tracked, and/or manually input to the plurality of simulators.

To consider $CO_2$, the level of $CO_2$ emissions is used from the simulators as the objective function, F, as performed in block 308 of FIG. 3. As previously noted, this level of $CO_2$ emissions may be tied to the choke schedule developed to assist evacuation of clean-up fluids from the wellbore. However, additional and/or alternative parameters may be controlled and/or used to determine a level of $CO_2$ emissions during the clean-up job.

Figure 10:
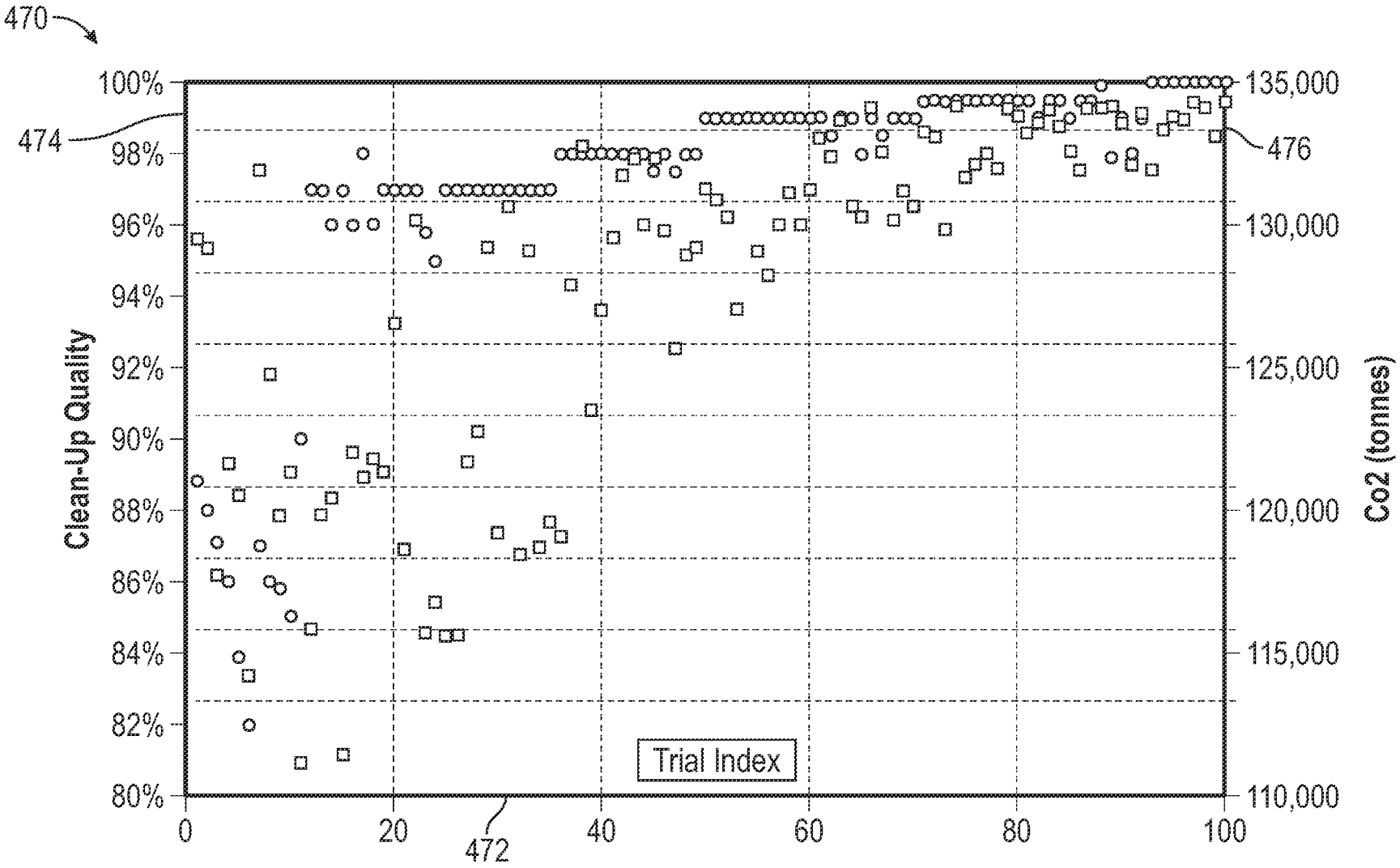
FIG. 10 illustrates a graph showing data points for different trials/simulations during the operation of the wellbore of FIG. 1, in accordance with embodiments of the present disclosure.

$CO_2$ emissions may be calculated for particular designs, choke schedules, and/or other parameters using the foregoing techniques. For instance, FIG. 10 shows a graph 470 that represents data points for different trials/simulations that are plotted along axis 472 with resulting clean-up quality along axis 474. The axis 474 represents a quality of clean-up that is a ratio of hydrocarbons to the total wellbore fluid volume. The trial points along the axis 472 may also be plotted against axis 476 that corresponds to a level of $CO_2$ emissions. Thus, selection of various parameters (e.g., choke schedule) may at least partially factor into how much $CO_2$ is emitted. As the trial index changes, the clean-up quality generally increases while the amount of $CO_2$ emitted is more sporadic though generally increasing as well. In one embodiment, the trials/results may be filtered over both goals where one design/trial settings may be selected that minimizes the emission of $CO_2$ while achieving a reasonable level/threshold of clean-up quality. Additionally or alternatively, an objective measure may be augmented to implicitly account for both competing goals explicitly using a multi-objective solution as discussed below.

Using the trial data, the trial index, clean-up quality, job time (hours) and $CO_2$ emissions (tons) may be stored in a ranked-order table. For instance, Table 6 below may represent an example of trials run using real-world numbers, simulation, emulation, and/or any other suitable techniques.

TABLE 6

Ranked-order table showing trial index, clean-up quality, job time, and $CO_2$ emissions for multiple trials.

| Trial | Clean-up Quality | Job Time | $CO_2$ Emission |
|---|---|---|---|
| 93 | 100.0 | 33.6 | 131,921 |
| 88 | 99.9 | 31.2 | 134,145 |
| 71 | 99.5 | 36.5 | 129,843 |
| 50 | 99.0 | 34.3 | 127,064 |
| 17 | 98.0 | 29.5 | 119,037 |
| 12 | 97.0 | 33.8 | 116,582 |
| 14 | 96.0 | 36.6 | 115,709 |
| 24 | 95.0 | 26.9 | 116,766 |
| . . . | . . . | . . . | . . . |
| 6 | 82.0 | 40.2 | 114,227 |

As previously noted, the level of $CO_2$ emissions may be extracted for any wellbore clean-up optimizations using one or more suitable techniques: pre-computation and tabulation of all outputs, coupled simulation, and partial pre-computation and tabulation of outputs that are all addressed separately in the following sections.

Pre-Compute and Tabulation of all Outputs

In this approach, a more extensive pre-job computation may be performed using the commercial process facility simulator since the wellbore clean-up simulator may not yield equivalent $CO_2$ emissions of any facilities without the commercial process facility simulator. The commercial process facility simulator may be used to perform a pre-job computation, such as is similar to the process 420 of FIG. 7. The pre-job computations may cover a range of hydrocarbon flow rates and energy usage of the equipment configuration. The tables used to store the results may be a multi-dimensional table that includes likely $CO_2$ emission per unit of hydrocarbon liquids produced, likely $CO_2$ emission per unit of hydrocarbon gases produced, likely $CO_2$ emission associated with energy consumption of facilities (may be function of fluid throughput), variations of emissions for different equipment configurations, and/or other suitable parameters. The resulting table may include parameters derived from outputs of the wellbore clean-up simulator, such as surface rates, upstream choke pressure, etc. With these pre-generated tables with the expansive outputs, the objective function determination may be performed without explicit calls to the commercial process facility simulator during run time.

The length of how long the pre-computation would take to complete would be a function of granularity of the sampling of the input one or more sets(S) of parameters (e.g., block 422). For instance, S may represent a set of all possible liquid flowrates ($Q_{oil}$, $Q_{cushion}$, $Q_{mud}$, $Q_{filtrate}$, etc.), volumetric flow rate of gas, pressure (e.g., at surface choke outlet), temperature, facility energy requirements by clean-up job, and/or any other properties associated with a clean-up job that may impact $CO_2$ emissions (e.g., transportation of equipment, removal of solids and surface clean-up, etc.). As may be appreciated, as the granularity of S increases (e.g., more samples), the consumption of computing resources may increase. Thus, a balance may be struck between high compute resource requirements for large numbers of samples and diminished solution accuracy due to sampling that is too sparse.

Coupled Simulators

In place of and/or in addition to pre-computing a relatively large number of outputs, the wellbore clean-up simulator and the commercial process facility simulator may function together in a coupled configuration (i.e., coupling their codes together) as previously discussed in relation to FIG. 5. To achieve such a flexible and accurate prediction of $CO_2$ emissions in both hydrocarbon flaring, burning, and equipment energy function, the simulators may be coupled. For instance, the wellbore clean-up simulator may have the flowrates of each phase first computed as functions of choke settings/adjustments. The flowrates, pressures, and temperatures are then passed from the wellbore clean-up simulator to the commercial process facility simulator. Using that data, the commercial process facility simulator then extracts the $CO_2$ emissions. Fluid flow rates and required condition changes through surface equipment (and related mechanical efficiencies) enable the commercial process facility simulator to calculate $CO_2$ equivalent emissions.

Partial Pre-Computation (Hybrid)

In some embodiments, it may be impossible or impractical to couple the codes of the wellbore clean-up simulator and the commercial process facility simulator due to the complexity and/or compatibility of the information exchanged between the simulators. To at least partially alleviate such issues, a hybrid approach may be adopted where some parameters are pre-computed while others are evaluated by the commercial process facility simulator on demand. Thus, when a computation is particularly expensive (e.g., time-wise and/or resource-wise), it may be omitted from pre-computation and instead be performed on-demand similar to the complex constraints discussed previously. For instance, when performing $CO_2$ emission computation, the commercial process facility simulator may function similarly to the coupled simulators previously discussed except that the commercial process facility simulator may determine the liquid flowrates without considering pressure, temperature, energy requirements, and/or any other aspects that may impact facility operations. In other words, the simulations may be restricted to volumetric flowrates and/or their corresponding $CO_2$ emissions. These values may be stored in tables to be later used to determine flow rates and/or $CO_2$ emissions from other measurements. At this later time, outputs of the wellbore clean-up simulator may be determined and used to find outputs of the wellbore clean-up simulator. These outputs along with the looked up flowrates values (and/or corresponding $CO_2$ emissions) are used in the commercial process facility simulator to determine the overall $CO_2$ emissions. For instance, in some embodiments, the commercial process facility emulator may determine $CO_2$ emissions attributable to flowrates and storing such data in the table(s). Later, the commercial process facility emulator may obtain outputs from the wellbore clean-up simulator to determine additional $CO_2$ emissions from those outputs. The two $CO_2$ emissions may then be added together to determine the overall $CO_2$ emissions. Additionally or alternatively, the pre-computed parameters may be intermediate measurements (e.g., flowrates, etc.) with $CO_2$ emissions being computed alongside the $CO_2$ emissions calculations based on the outputs of the wellbore clean-up simulator.

Multi-Objective Optimization

As previously noted, two goals of maximizing wellbore clean-up and minimizing the total $CO_2$ emissions result in a multi-objective optimization problem. For the purposes of discussion, let the original measure for wellbore clean-up be defined as function $f_1(X)$, where X represents the set of n control variables in the problem. Also, $f_2(X)$ is defined as the second measure for $CO_2$ emissions.

One method for managing the dual objective problem includes implicitly treating both goals into a single objective or by eliminating one goal in preference of the other by constraint assignment. In the former, the measures may be standardized and combined using weights, such as that shown in the following equation:

$$\min F(X) = w_1 \bar{f}_1(X) + w_2 f_2(X), \quad \text{(Equation 2)}$$

where $w_1$ is the weight for the wellbore clean-up function $f_1$, $w_2$ is the weight for the wellbore clean-up function $f_2$, and $\bar{f}_1(X)=-f_1(X)$ as a minimization of the wellbore clean-up goal.

Figure 11:
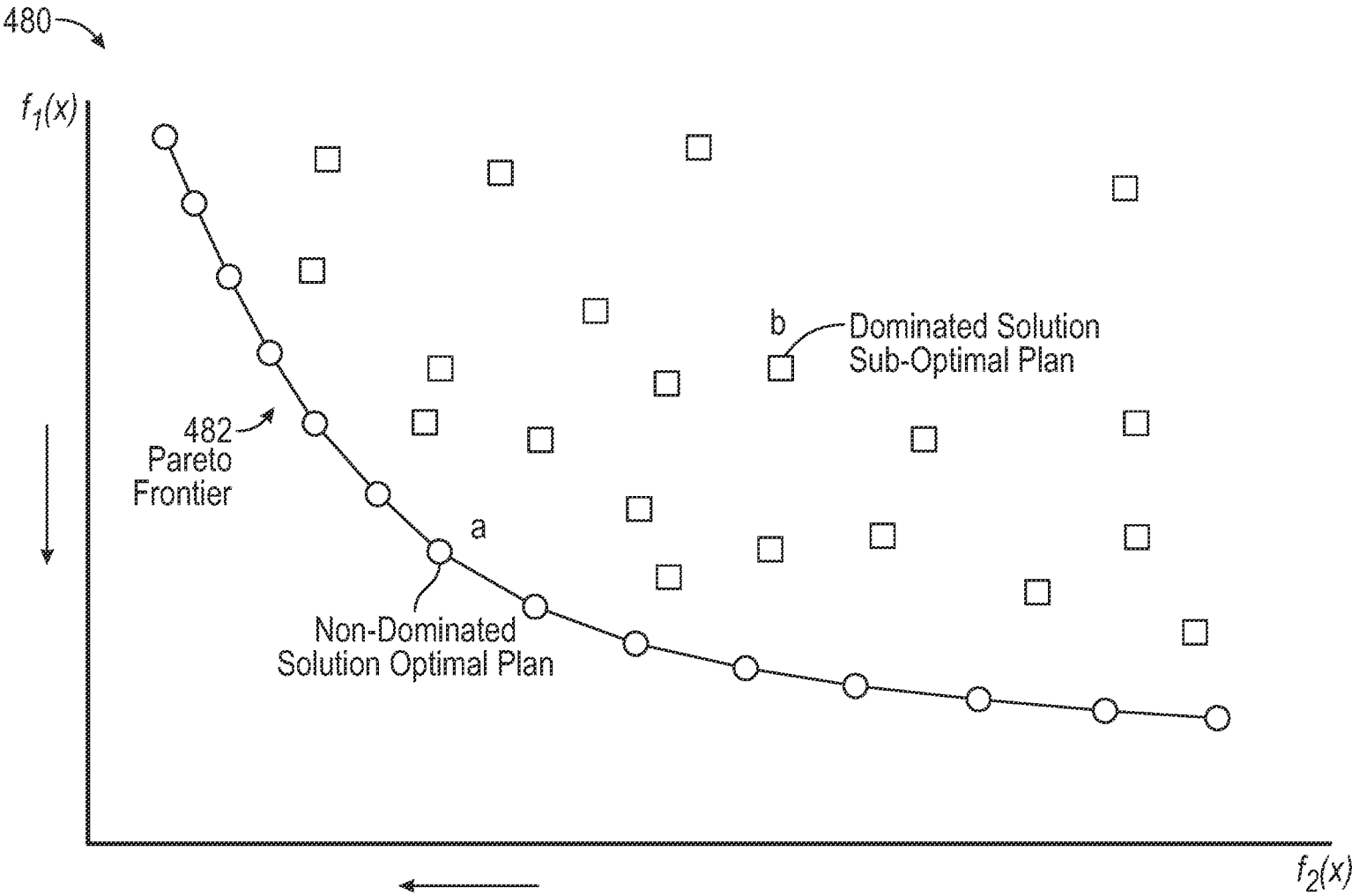
FIG. 11 illustrates a graph of a Pareto Front for a multi-objective problem for the wellbore of FIG. 1, in accordance with embodiments of the present disclosure.

The advantage of this approach is that it provides a simple way to combine multiple objectives, and any suitable non-linear optimization procedure can be applied to the combined objective for solution, as it could to any one objective alone (e.g., $f_1(X)$ previously). The disadvantage, however, is that the weights may not be well understood, and indeed, the linear combination may not ensure full discovery of the Pareto Front. As shown in FIG. 11, a graph 480 includes a Pareto Front 482 that defines the set of all optimal (non-dominated) solutions that are indicative of the trade-off between each sub-objective. Hence, the advantage in solution procedure is at the cost of a potentially less well developed, and therefore less well understood, Pareto Front. Conversion of one goal to a constraint may help identify a better Pareto Front when anticipated to be non-convex in form. However, the relegation of goals, their preferential ordering and level stipulation is far from trivial, especially when considering many goals.

The second approach is to consider both objectives explicitly. Without loss, we define the multi-objective optimization problem as follows:

$$\min F(X) = \min([\bar{f}_1(X), f_2(X)], \quad \text{(Equation 3)}$$

where each sub-objective is treated separately by the optimization procedure intended for that purpose. As shown in FIG. 11, a multi-objective optimization scheme will aim to determine the collection of non-dominated solutions (empty squares) that identify the Pareto Front 482. In the FIG. 11, both sub-objectives are to be minimized. Thus, the extreme points of the Pareto Front 482 indicate the optimal value of one measure at the cost of the other. Along the Pareto Front 482, there is a trade-off between both objectives. The dominated/sub-optimal solutions appear above the Pareto Front and are typically undesirable. For the present problem however, if the full clean-up is necessary, the degradation of $f_2(x)$ may warrant dominated solutions within a tolerable range of the Pareto Front 482.

Reducing $CO_2$ Emissions with Facility Design

Figure 12:
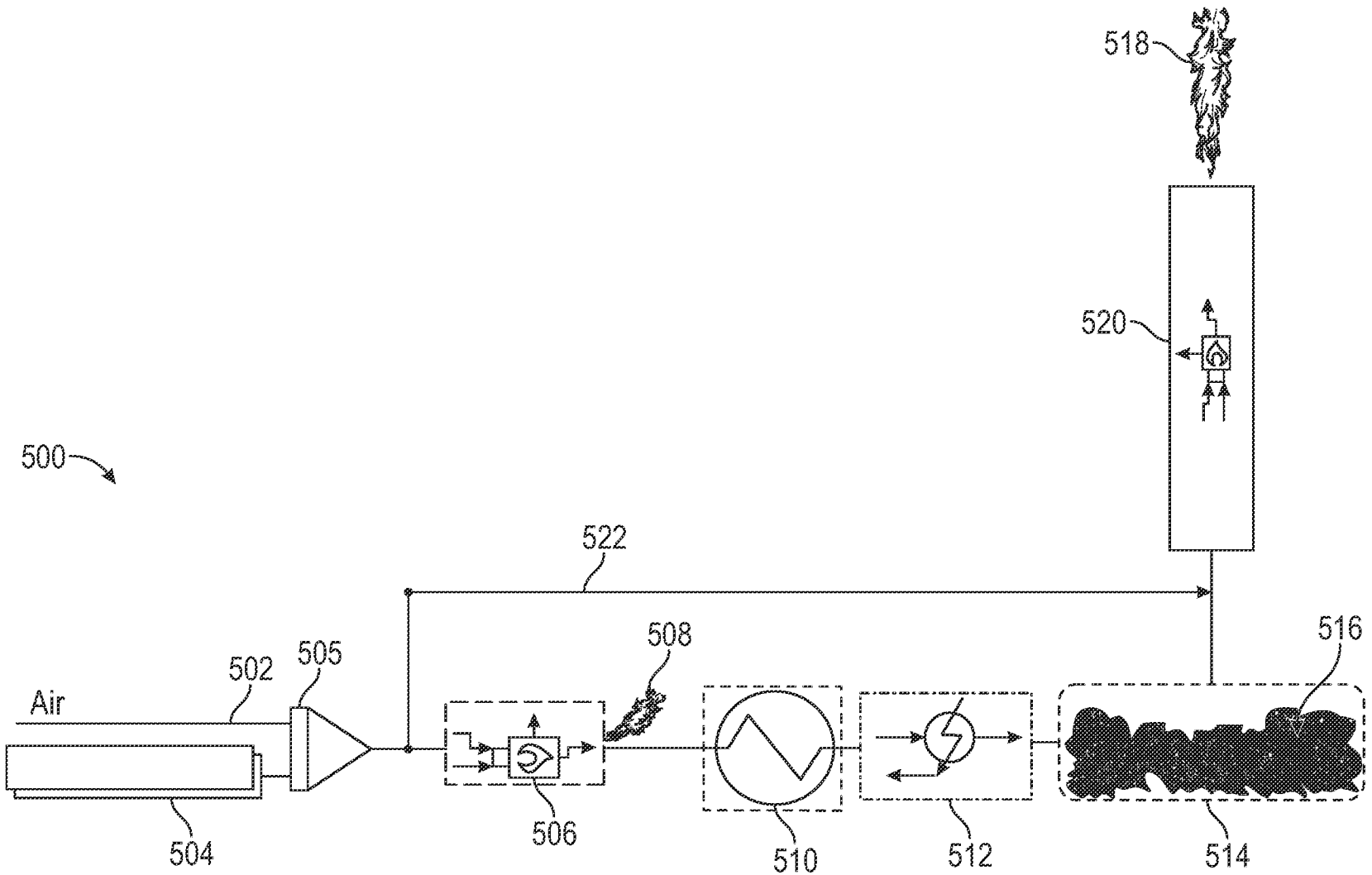
FIG. 12 illustrates a system for reducing $CO_2$ emissions during an operation of the wellbore of FIG. 1, in accordance with embodiments of the present disclosure.

To reduce $CO_2$ emissions, the facility may be redesigned to reduce/minimize $CO_2$ emissions for optimization of a wellbore clean-up without (excessively) compromising clean-up quality. For instance, system 500 of FIG. 12 may illustrate a facility that uses a Boudouard reaction to reduce $CO_2$ emissions. The Boudouard reaction is defined as $2CO \leftrightarrows CO_2+C$. The system 500 receives air 502 and hydrocarbons 504. The hydrocarbons 504 and air 502 are mixed in a mixer 505 and passed to a partially oxidized burner 506. The partially oxidized burner 506 burns the hydrocarbons 504 and produces syngas 508 that is passed to a heat exchanger 510 and/or air cooler 512 to cool the syngas 508 that is then passed to a collector 514 that collects carbon as soot that drops from the cooled syngas 508 as soot. The heat exchanger 510 may be stationed prior to the air cooler 512 to keep a flare flame 518 in a flare stack 520 as similar as possible to a flaring process without the reduced $CO_2$ emissions due to the collector 514. The system 500 may also use a trim feed 522 for air 502 and/or hydrocarbons 504 to bypass the partially oxidized burner 506 to enable additional flare temperature control for the flare stack 520. In other words, the partially oxidized burner 506, heat exchanger 510, air cooler 512, and/or collector 514 removes at least some carbon content from flue gas as solid soot 516. For instance, if 100 mols of carbon is in the hydrocarbons 504 and b is the amount of mols of carbon in the soot 516, the flare stack 520 may output 100-*b* mols of carbon as $CO_2$.

Figure 13:
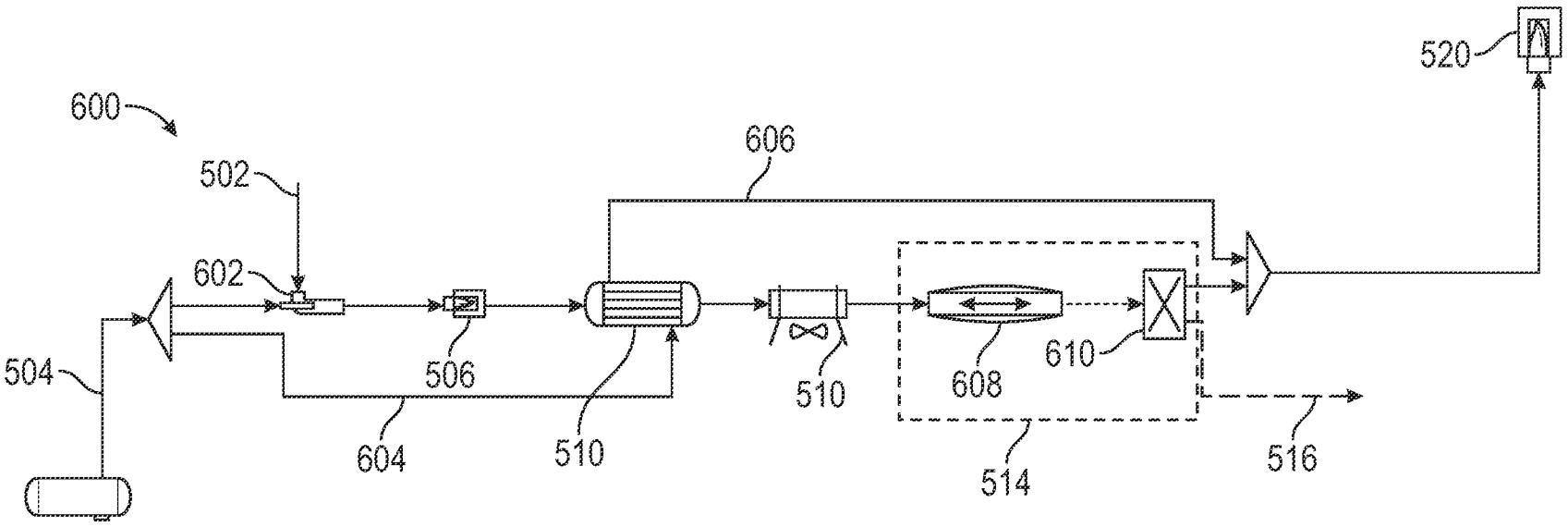
FIG. 13 illustrates a system for reducing $CO_2$ emissions during an operation of the wellbore of FIG. 1, in accordance with embodiments of the present disclosure.

FIG. 13 shows a system 600 that is another embodiment (or more detailed embodiment) of the system 500. The system 600 functions similar to the functions discussed in relation to the system 500 of FIG. 12. The system 600 also shows a nozzle and throat 602 that may at least partially determine how much soot 516 is dropped out of the syngas 508 in the collector 514. For instance, with one setting (e.g., throat diameter of 24" and nozzle diameter of 18"), a first percentage (10%) of $CO_2$ emissions may be reduced while another setting (e.g., throat diameter of 36" and nozzle diameter of 24") may cause reduction by a second percentage (e.g., 20%) by changing the mixture in the partially oxidized burner 506. The trim feed may also include a cold trim feed 604 and a hot trim feed 606. Likewise, the collector 514 may include a dropout chamber 608 where carbon laydown 610 results in the soot 516.

The techniques presented and claimed herein are referenced and applied to material objects and concrete examples of a practical nature that demonstrably improve the present technical field and, as such, are not abstract, intangible, or purely theoretical. Moreover, although various actions are discussed as part of processes in a specific order, at least some of the actions may be performed in different orders. Additionally, at least some of the actions may be performed by one or more processors 256 of suitable computing devices. Further, if any claims appended to the end of this specification contain one or more elements designated as "means for [perform]ing [a function] . . . " or "step for [perform]ing [a function] . . . ," it is intended that such elements are to be interpreted under 35 U.S.C. § 112 (f). However, for any claims containing elements designated in any other manner, it is intended that such elements are not to be interpreted under 35 U.S.C. § 112 (f).

What is claimed is:

1. A method, comprising:

at a first time, before performing a cleanup operation of a wellbore, receiving a plurality of sets of parameters related to the cleanup operation;

at the first time, simulating at least a portion of the cleanup operation using the plurality of sets of parameters to determine a functional relationship between $CO_2$ emissions and the plurality of sets of parameters during the cleanup operation;

recording pertinent results from simulating the portion of the cleanup operation;

storing results comprising the $CO_2$ emissions for the cleanup operation in an a priori table;

at a second time, while performing the cleanup operation, identifying a set of real-world operating conditions associated with the cleanup operation;

at the second time, using the set of real-world operating conditions and the functional relationship between the $CO_2$ emissions and the plurality of sets of parameters, interpolating operating $CO_2$ emissions from the a priori table; and using the operating $CO_2$ emissions to control the cleanup operation.

2. The method of claim 1, wherein the plurality of sets of parameters comprises historic real-world conditions of the wellbore.

3. The method of claim 1, wherein simulating the cleanup operation using the plurality of sets of parameters comprises simulating the cleanup operation using a plurality of coupled simulators.

4. The method of claim 3, wherein the plurality of coupled simulators comprises a commercial process facility simulator.

5. The method of claim 3, wherein the plurality of coupled simulators comprises a wellbore clean-up simulator.

6. The method of claim 3, comprising determining, using a commercial process facility simulator, additional $CO_2$ emissions at the second time using outputs of a wellbore cleanup simulator.

7. The method of claim 1, wherein determining the functional relationship includes determining a plurality of simulated $CO_2$ emissions for the plurality of sets of parameters.

8. The method of claim 1, wherein determining the functional relationship includes determining fluid behavior as a function of a choke schedule.

9. The method of claim 1, wherein the functional relationship between $CO_2$ emissions and the plurality of sets of parameters includes at least one of equivalent $CO_2$ emissions based on energy consumption of equipment, flare $CO_2$ emissions emanating from gas flaring, or burning $CO_2$ emissions emanating from burning of liquid hydrocarbons.

10. A system, comprising:

a processor and memory, the memory including instructions that cause the processor to:

at a first time before performing a cleanup operation of a wellbore, receive a plurality of sets of parameters related to the cleanup operation;

at the first time, simulate at least a portion of the cleanup operation using the plurality of sets of parameters to determine a functional relationship between $CO_2$ emissions and the plurality of sets of parameters during the cleanup operation;

record pertinent results from simulating the portion of the cleanup operation;

store results comprising the $CO_2$ emissions for the cleanup operation in an a priori table;

at a second time while performing the cleanup operation, identify a set of real-world operating conditions associated with the cleanup operation;

at the second time, using the set of real-world operating conditions and the functional relationship between the $CO_2$ emissions and the plurality of sets of parameters, interpolate operating $CO_2$ emissions from the a priori table; and use the operating $CO_2$ emissions to manage the cleanup operation.

11. A non-transitory computer-readable storage medium comprising computer-executable instructions executable by a computer processor, the computer-executable instructions comprising instructions to:

at a first time before performing a cleanup operation of a wellbore, receive a plurality of sets of parameters related to the cleanup operation;

at the first time, simulate at least a portion of the cleanup operation using the plurality of sets of parameters to determine a functional relationship between $CO_2$ emissions and the plurality of sets of parameters during the cleanup operation, wherein the functional relationship includes fluid behavior as a function of a choke schedule;

record pertinent results from simulating the portion of the cleanup operation;

store results comprising the $CO_2$ emissions for the cleanup operation in an a priori table;

at a second time while performing the cleanup operation, identify a set of real-world operating conditions associated with the cleanup operation;

at the second time, using the set of real-world operating conditions and the functional relationship between the $CO_2$ emissions and the plurality of sets of parameters, interpolate operating $CO_2$ emissions from the a priori table; and use the operating $CO_2$ emissions to manage the cleanup operation.

* * * * *